US011845272B2

(12) United States Patent
Yoshida

(10) Patent No.: US 11,845,272 B2
(45) **Date of Patent: *Dec. 19, 2023**

(54) LIQUID JET HEAD AND LIQUID JET RECORDING DEVICE

(71) Applicant: SII PRINTEK INC., Chiba (JP)

(72) Inventor: Kensuke Yoshida, Chiba (JP)

(73) Assignee: SII PRINTEK INC., Chiba (JP)

( * ) Notice: Subject to any disclaimer, the term of this patent is extended or adjusted under 35 U.S.C. 154(b) by 117 days.

This patent is subject to a terminal disclaimer.

(21) Appl. No.: 17/486,379

(22) Filed: Sep. 27, 2021

(65) Prior Publication Data

US 2022/0111641 A1 Apr. 14, 2022

(30) Foreign Application Priority Data

Oct. 13, 2020 (JP) ..... 2020-172782

(51) Int. Cl.
*B41J 29/38* (2006.01)
*B41J 2/045* (2006.01)

(52) U.S. Cl.
CPC ..... *B41J 2/04588* (2013.01); *B41J 2/04581* (2013.01)

(58) Field of Classification Search
CPC ..... B41J 2/04581; B41J 2/04508; B41J 2/04588
See application file for complete search history.

(56) References Cited

U.S. PATENT DOCUMENTS

2008/0284806 A1* 11/2008 Iriguchi ..... B41J 2/04581 347/10
2009/0213156 A1* 8/2009 Okada ..... B41J 2/04596 347/13
2010/0238217 A1* 9/2010 Matsushita ..... B41J 2/0456 29/890.1

FOREIGN PATENT DOCUMENTS

JP 2017-170652 A 9/2017

* cited by examiner

*Primary Examiner* — Lam S Nguyen
(74) *Attorney, Agent, or Firm* — Crowell & Moring LLP

(57) ABSTRACT

A liquid jet head and so on capable of enhancing the convenience while improving the performance are provided. The liquid jet head according to an embodiment of the present disclosure includes a jet section configured to jet liquid, at least one drive device which applies a drive signal having a predetermined drive waveform to the jet section to thereby cause the jet section to jet the liquid, and a waveform setting section configured to generate regular waveform configuration information for setting the drive waveform based on simplified waveform configuration information supplied from an outside of the liquid jet head. The waveform setting section converts the simplified waveform configuration information including at least one type of reference potential value set along a time axis into the regular waveform configuration information including a plurality of types of power supply potential values set for each of the reference potential values to thereby generate the regular waveform configuration information based on the simplified waveform configuration information.

10 Claims, 14 Drawing Sheets

MODIFIED EXAMPLE 1

FIG. 6A

| REFERENCE POTENTIAL VALUE V1 | |
|---|---|
| 0b00 | GND |
| 0b01 | VP |
| 0b10 | VM |

FIG. 6B

| ASW_SEL | POWER SUPPLY POTENTIAL VALUE V2 |
|---|---|
| 0x01 | GND1 |
| 0x02 | GND2 |
| 0x04 | VP1 |
| 0x08 | VP2 |
| 0x10 | VM1 |
| 0x20 | VM2 (=VC) |

(TRANSMISSION CONTROL ACTION)

(BLOCKING CONTROL ACTION)

MODIFIED EXAMPLE 1

FIG. 10A

MODIFIED EXAMPLE 1

| REFERENCE POTENTIAL VALUE V1 | |
|---|---|
| 0b00 | GND |
| 0b01 | VP |
| 0b10 | VM |

FIG. 10B

MODIFIED EXAMPLE 1

| ASW_SEL | POWER SUPPLY POTENTIAL VALUE V2 |
|---|---|
| 0x01 | GND1 |
| 0x02 | GND2 |
| 0x04 | VP1 |
| 0x08 | VP2 |
| 0x10 | VM1 |
| 0x20 | VPH (=VC) |

MODIFIED EXAMPLE 2

MODIFIED EXAMPLE 3

MODIFIED EXAMPLE 3 (DIRECT CONTROL COMMUNICATION)

MODIFIED EXAMPLE 3 (INDIRECT CONTROL COMMUNICATION)

MODIFIED EXAMPLE 3 (INDIRECT CONTROL COMMUNICATION)

LIQUID JET HEAD AND LIQUID JET RECORDING DEVICE

RELATED APPLICATIONS

This application claims priority to Japanese Patent Application No. 2020-172782, filed on Oct. 13, 2020, the entire content of which is incorporation herein by reference.

BACKGROUND OF THE INVENTION

1. Field of the Invention

The present disclosure relates to a liquid jet head and a liquid jet recording device.

2. Description of the Related Art

Liquid jet recording devices equipped with liquid jet heads are used in a variety of fields, and a variety of types of liquid jet heads have been developed (see, e.g., JP-A-2017-170652 (Patent Literature 1)).

In such a liquid jet head, in general, it is required to improve the performance, and to enhance the convenience.

It is desirable to provide a liquid jet head and a liquid jet recording device capable of enhancing the convenience while improving the performance.

SUMMARY OF THE INVENTION

A liquid jet head according to an embodiment of the present disclosure includes a jet section configured to jet liquid, at least one drive device which applies a drive signal having a predetermined drive waveform to the jet section to thereby cause the jet section to jet the liquid, and a waveform setting section configured to generate regular waveform configuration information for setting the drive waveform based on simplified waveform configuration information supplied from an outside of the liquid jet head. The waveform setting section converts the simplified waveform configuration information including at least one type of reference potential value set along a time axis into the regular waveform configuration information including a plurality of types of power supply potential values set for each of the reference potential values to thereby generate the regular waveform configuration information based on the simplified waveform configuration information.

A liquid jet recording device according to an embodiment of the present disclosure includes the liquid jet head according to the embodiment of the present disclosure.

According to the liquid jet head and the liquid jet recording device related to the embodiment of the present disclosure, it becomes possible to enhance the convenience while improving the performance.

BRIEF DESCRIPTION OF THE DRAWINGS

FIG. 6A is a schematic diagram showing a detailed configuration example of a reference potential value shown in FIGS. 5A and 5B.

FIG. 6B is a schematic diagram showing a detailed configuration example of a power supply potential value shown in FIGS. 5A and 5B.

FIG. 10A is a schematic diagram showing a detailed configuration example of a reference potential value shown in FIGS. 9A and 9B.

FIG. 10B is a schematic diagram showing a detailed configuration example of a power supply potential value shown in FIGS. 9A and 9B.

DETAILED DESCRIPTION OF THE PREFERRED EMBODIMENTS

An embodiment of the present disclosure will hereinafter be described in detail with reference to the drawings. It should be noted that the description will be presented in the following order.

1. Embodiment (a basic configuration example using a variety of types of waveform configuration information and a control line)
2. Modified Examples
   - Modified Example 1 (a modified example related to simplified waveform configuration information and regular waveform configuration information)
   - Modified Example 2 (an example in which a waveform storing section for storing the simplified waveform configuration information is further provided)

Modified Example 3 (an example in which switching between indirect control communication and direct control communication is performed)

3. Other Modified Examples

1. EMBODIMENT

[Schematic Configuration of Printer 5]

Figure 1:
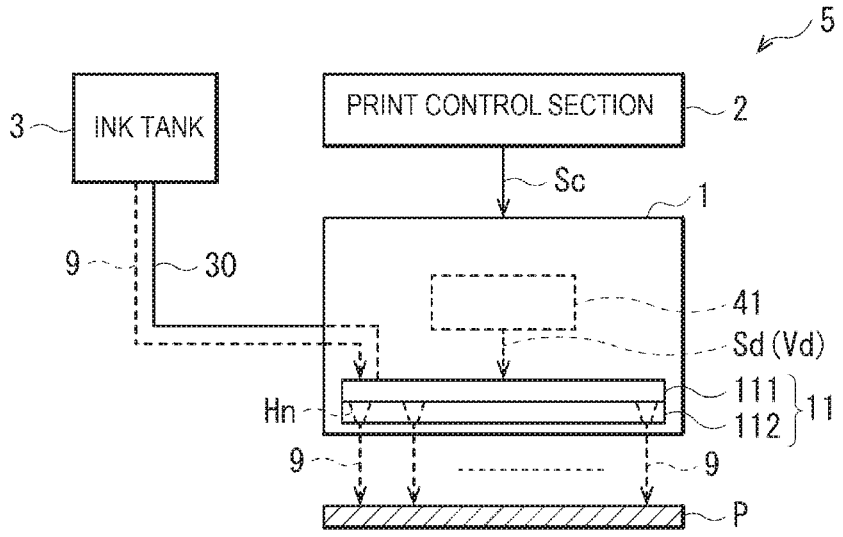
FIG. 1 is a block diagram showing a schematic configuration example of a liquid jet recording device according to an embodiment of the present disclosure.
Figure 2:
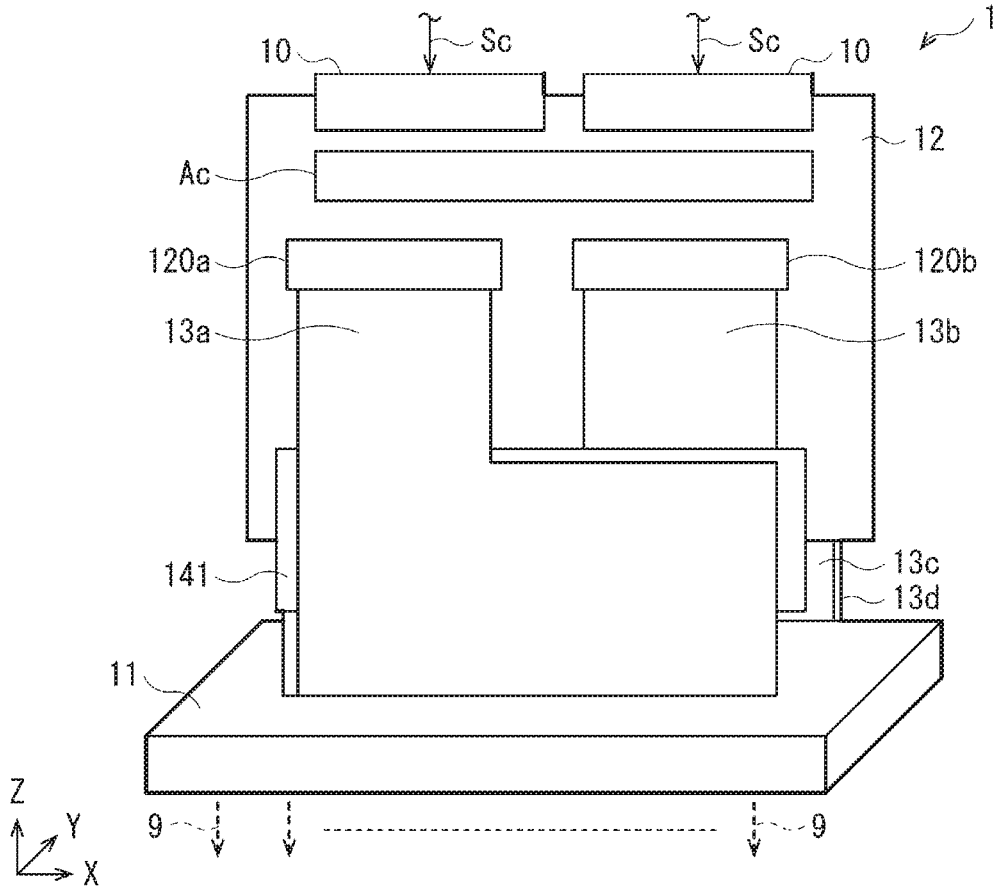
FIG. 2 is a perspective view schematically showing a schematic configuration example of a liquid jet head shown in FIG. 1.
Figure 3:
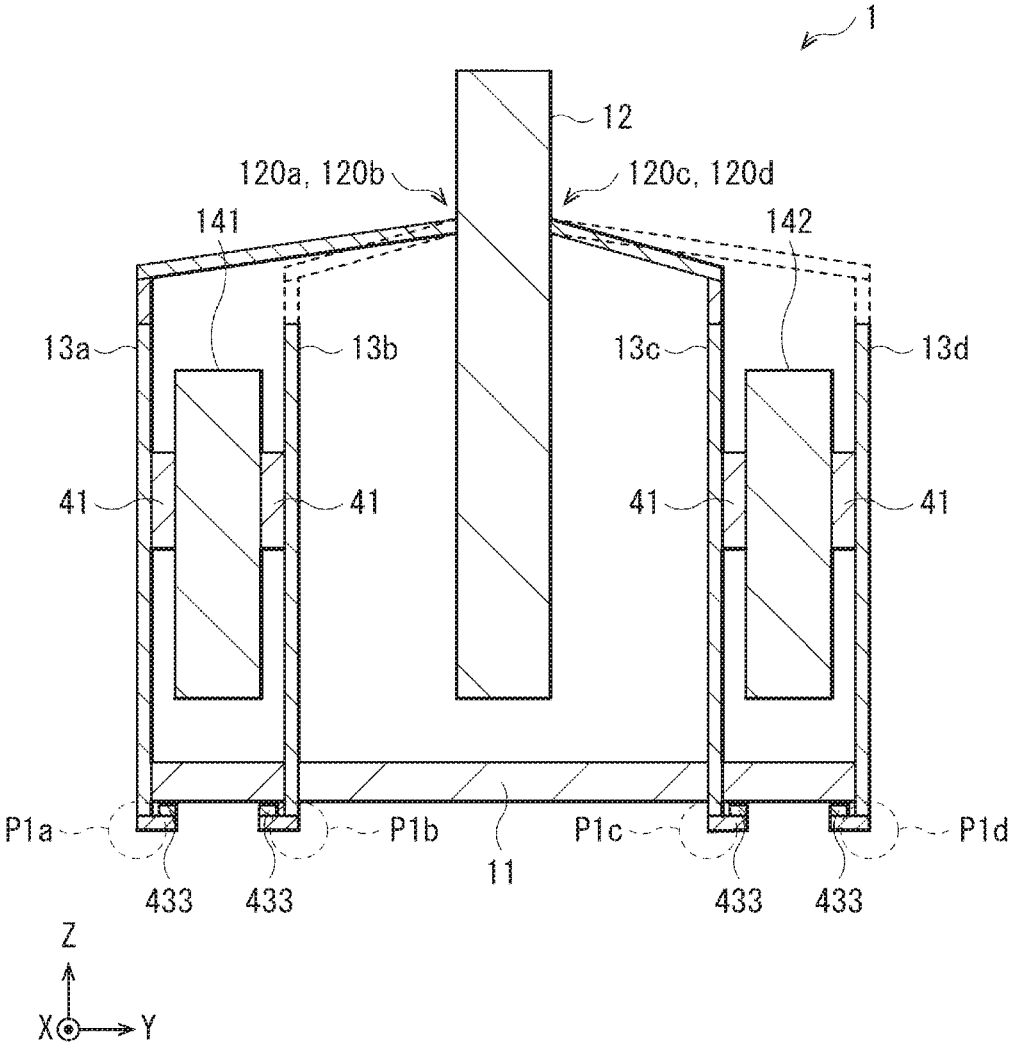
FIG. 3 is a cross-sectional view schematically showing a configuration example of the liquid jet head shown in FIG. 2.

FIG. 1 is a block diagram showing a schematic configuration example of a printer 5 as a liquid jet recording device according to an embodiment of the present disclosure. FIG. 2 is a perspective view schematically showing a schematic configuration example of an inkjet head 1 as a liquid jet head shown in FIG. 1. FIG. 3 is a cross-sectional view (a Y-Z cross-sectional view) schematically showing a configuration example of the inkjet head 1 shown in FIG. 2.

It should be noted that the scale size of each of the members is accordingly altered so that the member is shown large enough to recognize in the drawings used in the description of the specification.

The printer 5 is an inkjet printer for performing recording (printing) of images, characters, and the like on a recording target medium (e.g., recording paper P shown in FIG. 1) using ink 9 described later. As shown in FIG. 1, the printer 5 is provided with the inkjet head 1, a print control section 2, and an ink tank 3.

It should be noted that the inkjet head 1 corresponds to a specific example of a "liquid jet head" in the present disclosure, and the printer 5 corresponds to a specific example of a "liquid jet recording device" in the present disclosure. Further, the ink 9 corresponds to a specific example of a "liquid" in the present disclosure.

(A. Print Control Section 2)

The print control section 2 is for supplying the inkjet head 1 with a variety of types of information (data). Specifically, as shown in FIG. 1, the print control section 2 is arranged to supply each of constituents (drive devices 41 described later and so on) in the inkjet head 1 with a print control signal Sc.

It should be noted that the print control signal Sc is arranged to include, for example, image data, an ejection timing signal, and a power supply voltage for operating the inkjet head 1. Further, the print control section 2 corresponds to a specific example of an "outside of a liquid jet head" in the present disclosure.

(B. Ink Tank 3)

The ink tank 3 is a tank for containing the ink 9 inside. As shown in FIG. 1, the ink 9 in the ink tank 3 is arranged to be supplied to the inside (a jet section 11 described later) the inkjet head 1 via an ink supply tube 30. It should be noted that such an ink supply tube 30 is formed of, for example, a flexible hose having flexibility.

(C. Inkjet Head 1)

As represented by dotted arrows in FIG. 1, the inkjet head 1 is a head for jetting (ejecting) the ink 9 having a droplet shape from a plurality of nozzle holes Hn described later to the recording paper P to thereby perform recording of images, characters, and so on. As shown in, for example, FIG. 2 and FIG. 3, the inkjet head 1 is provided with a single jet section 11, a single I/F (interface) board 12, four flexible boards 13*a*, 13*b*, 13*c*, and 13*d*, and two cooling units 141, 142.

(C-1. I/F Board 12)

As shown in FIG. 2 and FIG. 3, the I/F board 12 is provided with two connectors 10, four connectors 120*a*, 120*b*, 120*c*, and 120*d*, and a circuit arrangement area Ac.

As shown in FIG. 2, the connectors 10 are each a part (a connector part) for inputting the print control signal Sc described above and supplied from the print control section 2 toward the inkjet head 1 (the flexible boards 13*a*, 13*b*, 13*c*, and 13*d* described later).

The connectors 120*a*, 120*b*, 120*c*, and 120*d* are parts (connector parts) for electrically coupling the I/F board 12 and the flexible boards 13*a*, 13*b*, 13*c*, and 13*d*, respectively.

The circuit arrangement area Ac is an area where a variety of circuits are arranged on the I/F board 12. It should be noted that it is also possible to arrange that such a circuit arrangement area is disposed in other areas on the I/F board 12.

(C-2. Jet Section 11)

As shown in FIG. 1, the jet section 11 is a part which has the plurality of nozzle holes Hn, and jets the ink 9 from these nozzle holes Hn. Such jet of the ink 9 is arranged to be performed (see FIG. 1) in accordance with a drive signal Sd (a drive voltage Vd) supplied from each of the drive devices 41 described later on each of the flexible boards 13*a*, 13*b*, 13*c*, and 13*d*.

As shown in FIG. 1, such a jet section 11 is configured by including an actuator plate 111 and a nozzle plate 112.

(Nozzle Plate 112)

The nozzle plate 112 is a plate formed of a film material such as polyimide, or a metal material, and has the plurality of nozzle holes Hn described above as shown in FIG. 1. These nozzle holes Hn are formed side by side at predetermined intervals, and each have, for example, a circular shape.

Specifically, in the example of the jet section 11 shown in FIG. 2, the plurality of nozzle holes Hn in the nozzle plate 112 is constituted by a plurality of nozzle arrays (four nozzle arrays) in which the nozzle holes are arranged along the column direction (the x-axis direction). Further, these four nozzle arrays are arranged side by side along a direction (the Y-axis direction) perpendicular to the column direction.

(Actuator Plate 111)

The actuator plate 111 is a plate formed of a piezoelectric material such as PZT (lead zirconate titanate). The actuator plate 111 is provided with a plurality of channels (pressure chambers). These channels are each a part for applying a pressure to the ink 9, and are arranged side by side so as to be parallel to each other at predetermined intervals. Each of the channels is partitioned with drive walls (not shown) formed of a piezoelectric body, and forms a groove section having a recessed shape in a cross-sectional view.

In such channels, there exist ejection channels for ejecting the ink 9, and dummy channels (non-ejection channels) which do not eject the ink 9. In other words, it is arranged that the ejection channels are filled with the ink 9 on the one hand, but the dummy channels are not filled with the ink 9 on the other hand. It should be noted that it is arranged that filling of the ink 9 to each of the ejection channels is performed via, for example, a flow channel (a common flow channel) commonly communicated with such ejection channels. Further, it is arranged that each of the ejection channels is individually communicated with the nozzle hole Hn in the nozzle plate 112 on the one hand, but each of the dummy channels is not communicated with the nozzle hole Hn on the other hand. These ejection channels and the dummy channels are alternately arranged side by side along the column direction (the X-axis direction) described above.

Further, on the inner side surfaces opposed to each other in the drive wall described above, there are respectively disposed drive electrodes. As the drive electrodes, there exist common electrodes disposed on the inner side surfaces facing the ejection channels, and active electrodes (individual electrodes) disposed on the inside surfaces facing the dummy channels. These drive electrodes and the drive devices 41 described later are electrically coupled to each other via each of the flexible boards 13*a*, 13*b*, 13*c*, and 13*d*. Thus, it is arranged that the drive voltages Vd (the drive signals Sd) described above are applied to the drive electrodes from the drive devices 41 via the flexible boards 13*a*, 13*b*, 13*c*, and 13*d*.

(C-3. Flexible Boards 13*a*, 13*b*, 13*c*, and 13*d*)

The flexible boards 13*a*, 13*b*, 13*c*, and 13*d* are each a board for electrically coupling the I/F board 12 and the jet section 11 to each other as shown in FIG. 2 and FIG. 3. It is arranged that these flexible boards 13*a*, 13*b*, 13*c*, and 13*d* individually control the jet actions of the ink 9 in the four nozzle columns in the nozzle plate 112 described above, respectively. Further, as indicated by, for example, the reference symbols P1*a*, P1*b*, P1*c*, and P1*d* in FIG. 3, it is arranged that the flexible boards 13*a*, 13*b*, 13*c*, and 13*d* are folded around places (around clamping electrodes 433) where the flexible boards 13*a*, 13*b*, 13*c*, and 13*d* have contact with the jet section 11, respectively. It should be noted that it is arranged that electrical coupling between the clamping electrodes 433 and the jet section 11 is achieved by, for example, thermocompression bonding using an ACF (Anisotropically-Conductive Film).

On each of such flexible boards 13*a*, 13*b*, 13*c*, and 13*d*, there is individually mounted a single drive device 41 or a plurality of drive devices 41 (see FIG. 3). These drive devices 41 are each a device for outputting the drive signal Sd (the drive voltage Vd) for jetting the ink 9 from the nozzle holes Hn in the corresponding nozzle array in the jet section 11. It should be noted that this drive signal Sd has a predetermined drive waveform although the details will be described later. Therefore, it is arranged that such a drive signal Sd is output from each of the flexible boards 13*a*, 13*b*, 13*c*, and 13*d* to the jet section 11. It should be noted that such drive devices 41 are each formed of, for example, an ASIC (Application Specific Integrated Circuit).

Further, these drive devices 41 are each arranged to be cooled by the cooling units 141, 142 described above. Specifically, as shown in FIG. 3, the cooling unit 141 is fixedly disposed between the drive devices 41 on the flexible boards 13*a*, 13*b*, and by pressing the cooling unit 141 against these drive devices 41, the drive devices 41 are cooled. Similarly, the cooling unit 142 is fixedly disposed between the drive devices 41 on the flexible boards 13*c*, 13*d*, and by pressing the cooling unit 142 against these drive devices 41, the drive devices 41 are cooled. It should be noted that such cooling units 141, 142 can each be configured to use a variety of types of cooling mechanisms.

[Detailed Configuration of Inkjet Head 1]

Then, the detailed configuration example of the inkjet head 1 will be described with reference to FIG. 4 in addition to FIG. 1 through FIG. 3.

Figure 4:
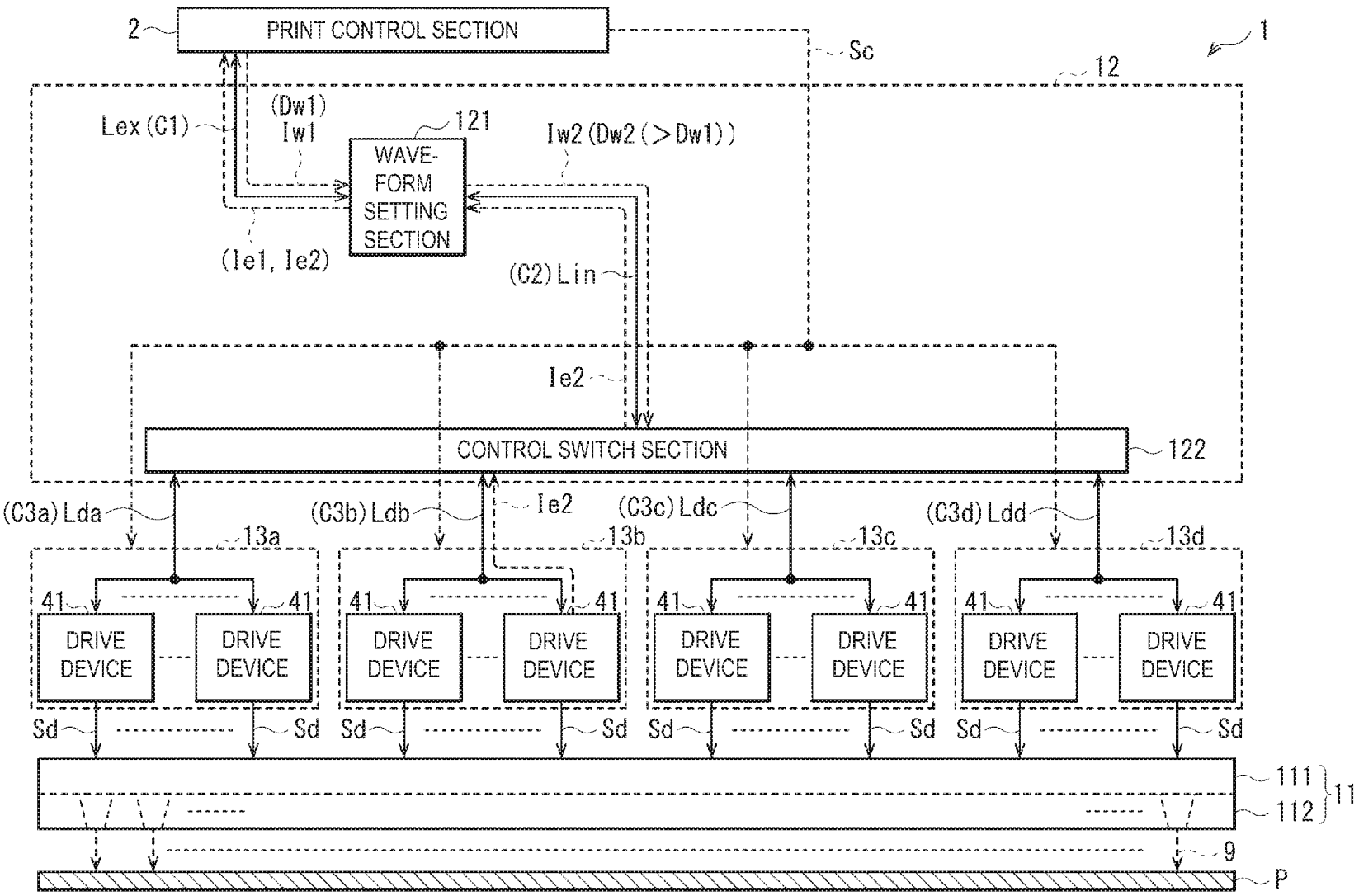
FIG. 4 is a block diagram showing a detailed configuration example of the liquid jet head shown in FIG. 1 through FIG. 3.

FIG. 4 is a block diagram showing a detailed configuration example the inkjet head 1 shown in FIG. 1 through FIG. 3. As shown in FIG. 4, the inkjet head 1 is provided with an external control line Lex, an internal control line Lin, and a plurality of (four in this example) drive control lines Lda through Ldd in addition to the I/F board 12, the flexible boards 13*a* through 13*d*, and the jet section 11. Further, the I/F board 12 has a waveform setting section 121 and a control switch section 122, and the flexible boards 13*a* through 13*d* each have the plurality of drive devices 41. It should be noted that the plurality of drive devices 41 in each of the flexible boards 13*a* through 13*d* is arranged to be, for example, series-connected (cascade-connected) to each other.

(Variety of Control Lines)

As shown in FIG. 4, the external control line Lex couples the outside (the print control section 2) of the inkjet head 1 and the waveform setting section 121 to each other, and is a control line for performing first control communication C1 described later between the outside and the waveform setting section 121.

As shown in FIG. 4, the internal control line Lin couples the waveform setting section 121 and the control switch section 122 to each other, and is a control line for performing second control communication C2 described later between the waveform setting section 121 and the control switch section 122.

The plurality of drive control lines Lda through Ldd couples the control switch section 122 and the drive devices 41 in the plurality of flexible boards 13*a* through 13*d* to each other, and is control lines for individually performing third control communication C3*a* through C3*d* described later between the control switch section 122 and the drive devices 41. Specifically, as shown in FIG. 4, the drive control line Lda couples the control switch section 122 and the drive devices 41 in the flexible board 13*a* to each other, and is arranged to perform the third control communication C3*a* between the control switch section 122 and the drive devices 41. Similarly, the drive control line Ldb couples the control switch section 122 and the drive devices 41 in the flexible board 13*b* to each other, and is arranged to perform the third control communication C3*b* between the control switch section 122 and the drive devices 41. The drive control line Ldc couples the control switch section 122 and the drive devices 41 in the flexible board 13*c* to each other, and is arranged to perform the third control communication C3*c* between the control switch section 122 and the drive devices 41. The drive control line Ldd couples the control switch section 122 and the drive devices 41 in the flexible board 13*d* to each other, and is arranged to perform the third control communication C3*d* between the control switch section 122 and the drive devices 41.

It should be noted that such a variety of control lines (the external control line Lex, the internal control line Lin, and the drive control lines Lda through Ldd) can each be a control line with wire or a control line without wire.

(Waveform Setting Section 121)

The waveform setting section 121 is for performing setting of the drive waveform in the drive signal Sd (see FIG. 4) supplied from each of the drive devices 41 to the jet section 11. Specifically, as shown in FIG. 4, the waveform setting section 121 is arranged to generate regular waveform configuration information Iw2 for setting a drive waveform based on simplified waveform configuration information Iw1 supplied from the outside (the print control section 2) of the inkjet head 1. Further, the waveform setting section 121 is arranged to generate the regular waveform configuration information Iw2 based on the simplified waveform configuration information Iw1 by converting the simplified waveform configuration information Iw1 transmitted from the print control section 2 using the first control communication C1 into the regular waveform configuration information Iw2 with a method described later.

It should be noted that the details of such simplified waveform configuration information Iw1 and such regular waveform configuration information Iw2 will be described later (see FIGS. 5A and 5B, FIG. 6A, and FIG. 6B), but as shown in FIG. 4, a data amount Dw1 in the simplified waveform configuration information Iw1 is made smaller than a data amount Dw2 in the regular waveform configuration information Iw2 (Dw1<Dw2).

Further, when the waveform setting section 121 has judged, although the details are described later, that the regular waveform configuration information Iw2 becomes inappropriate in content when generating the regular waveform configuration information Iw2 based on the simplified waveform configuration information Iw1 in such a manner as described above, the waveform setting section 121 gives the following error notification. Specifically, as shown in FIG. 4, the waveform setting section 121 is arranged to give the error notification by outputting first error information Ie1 using the first control communication C1 to the print control section 2 when the waveform setting section 121 has made such a judgment.

Further, the waveform setting section 121 is arranged to perform the error notification to the print control section 2 with respect to error information (second error information Ie2) detected in at least one of the drive devices 41 in the flexible boards 13*a* through 13*d*. Specifically, in the example shown in FIG. 4, the waveform setting section 121 collects and stores the second error information Ie2 from at least one drive device 41 (one of the drive devices 41 in the flexible board 13*b* in this example) described above using the third control communication C3*b* out of the third control communication C3*a* through C3*d*, and the second control communication C2. Then, the waveform setting section 121 is arranged to output the second error information Ie2 stored in such a manner to the print control section 2 using the first control communication C1 to thereby give the error notification.

In such second error information Ie2, the variety of types of errors (e.g., a CRC (Cyclic Redundancy Check) transmission error, and an error related to abnormal waveform setting and an abnormal drive action), and the drive devices 41 in which such an error is detected are stored so as to correspond to each other. Further, in each of the drive devices 41, for example, it is arranged that the detection of the second error information Ie2 is performed by, for example, the inspection in the start up of the inkjet head 1, and a cyclic inspection performed every predetermined time.

(Control Switch Section 122)

As shown in FIG. 4, the control switch section 122 is disposed between the waveform setting section 121 and the plurality of flexible board 13*a* through 13*d*. The control switch section 122 is arranged to perform a predetermined control switch action when transmitting the regular waveform configuration information Iw2, which has been transmitted using the second control communication C2 from the waveform setting section 121, to the drive devices 41 using the third control communication C3*a* through C3*d*. Specifically, the control switch section 122 performs the control switch action between a transmission control action and a blocking control action described below.

When performing the transmission control action, it is arranged that the regular waveform configuration information Iw2 is transmitted in parallel to the drive devices 41 in at least one of the plurality of flexible boards 13*a* through 13*d* using the third control communication (at least one of the third control communication C3*a* through C3*d*) on at least one of the plurality of drive control lines Lda through Ldd (see FIG. 7 described later).

In contrast, when performing the blocking control action, it is arranged that the transmission of the regular waveform configuration information Iw2 using the third control communication C3*a* through C3*d* is blocked with respect to all of the plurality of drive control lines Lda through Ldd (see FIG. 8 described later).

It should be noted that the details of the control switch action between such a transmission control action and such a blocking control action will be described later.

[Configuration of Waveform Configuration Information]

Then, a configuration example (a data configuration example) of a variety of types of waveform configuration information (the simplified waveform configuration information Iw1 and the regular waveform configuration information Iw2) described above will be described with reference to FIGS. 5A and 5B, FIG. 6A, and FIG. 6B in addition to FIG. 4.

Figures 5A, 5B:
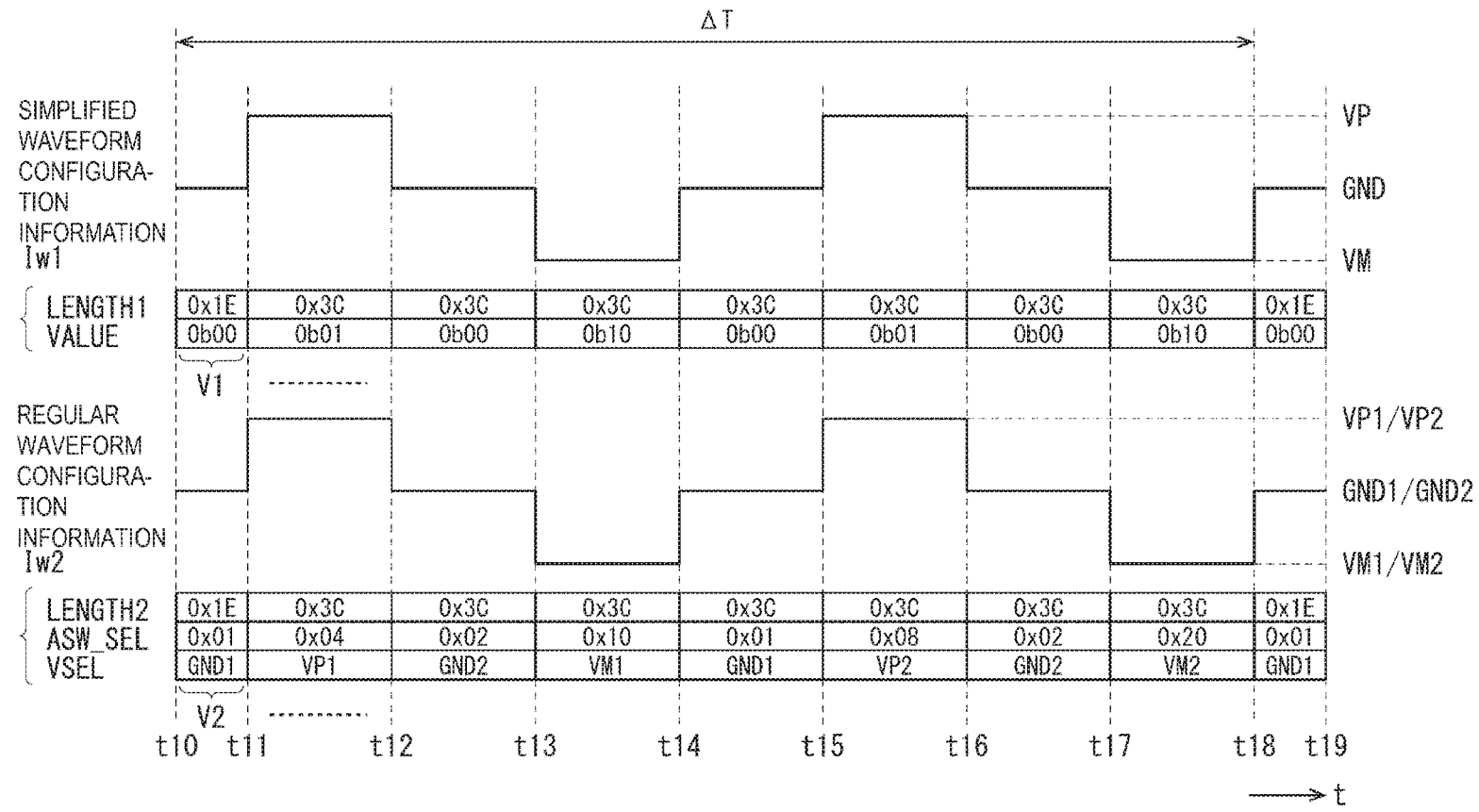
FIGS. 5A and 5B are timing charts showing a configuration example of simplified waveform configuration information and regular waveform configuration information shown in FIG. 4.

FIGS. 5A and 5B are timing charts showing a configuration example of the simplified waveform configuration information Iw1 (FIG. 5A) and a configuration example of the regular waveform configuration information Iw2 (FIG. 5B). It should be noted that the horizontal axis in FIGS. 5A and 5B represent time t. Further, FIG. 6A schematically shows a detailed configuration example of the reference potential value V1 described later shown in FIG. 5A, and FIG. 6B schematically shows a detailed configuration example of the power supply potential value V2 described later shown in FIG. 5B.

(Simplified Waveform Configuration Information Iw1)

The simplified waveform configuration information Iw1 (the first waveform configuration information) includes one type of reference potential value V1 or a plurality of types of reference potential values V1 set along the time axis. Specifically, as shown in FIG. 5A, the simplified waveform configuration information Iw1 has VALUE as reference potential value information and LENGTH1 as reference potential period information for a period of each of the reference potential values V1. Specifically, in the example shown in FIG. 5A, VALUE and LENGTH1 are set for each of the periods between timings t10 and t11, timings t11 and t12, timings t12 and t13, timings t13 and t14, timings t14 and t15, timings t15 and t16, timings t16 and t17, timings t17 and t18, and timings t18 and t19.

VALUE consists of arbitrary reference potential values V1 which are selected and set from one type of the reference potential value V1 or the plurality of types of reference potential values V1, and which are arranged side by side along the time axis. Specifically, in the example shown in FIG. 5A and FIG. 6A, VALUE is expressed by a binary value (2 bits), and the correspondence relationships with three types of reference potential values V1 are set as follows.

VALUE=0*b*00→*V*1=*GND* (ground potential)

VALUE=0*b*01→*V*1=*VP* (predetermined positive potential)

VALUE=0*b*10→*V*1=*VM* (predetermined negative potential)

LENGTH1 represents a period for each of the arbitrary reference potential values V1 in VALUE, and is expressed by the number of internal clock pluses (2 digits of a hexadecimal value) used in the drive devices 41 in the example shown in FIG. 5A. Specifically, for example, in the case of (internal clock period)=50 [ns], the period of 50 [ns]×16=800 [ns] is obtained in the case of LENGTH1=0x10, the period of 50 [ns]×30=1.5 [μs] is obtained in the case of LENGTH1=0x1E, the period of 50 [ns]×60=3.0 [μs] is obtained in the case of LENGTH1=0x3C.

(Regular Waveform Configuration Information Iw2)

The regular waveform configuration information Iw2 (second waveform configuration information) includes a plurality of types of power supply potential values V2 set for each of the reference potential values V1 in the simplified waveform configuration information Iw1. Specifically, as shown in FIG. 5B, the regular waveform configuration information Iw2 has ASW_SEL as power supply selection information, VSEL as power supply potential value information, and LENGTH2 as power supply potential period information for a period of each of the power supply potential values V2. Specifically, in the example shown in FIG. 5B, ASW_SEL, VSEL, and LENGTH2 are set for each of the periods between the timings t10 and t11, the timings t11 and t12, the timings t12 and t13, the timings t13 and t14, the timings t14 and t15, the timings t15 and t16, the timings t16 and t17, the timings t17 and t18, and the timings t18 and t19.

ASW_SEL is set for each of the arbitrary reference potential velus V1 (GND, VP, or VM described above) set in the simplified waveform configuration information Iw1, and is information for selecting one type of power supply potential value V2 out of the plurality of types of power supply potential values V2. Specifically, in the example shown in FIG. 5B and FIG. 6B, ASW_SEL is expressed by a hexadecimal value (2 digits), and the correspondence relationships with six types of power supply potential values V2 are set as follows. Specifically, it is arranged that GND1/GND2, VP1/VP2, and VM1/VM2 are individually set in accordance with each of the reference potential values V1=GND, VP, and VM. It should be noted that in this example, it is arranged that a negative potential (a second negative potential) is set to VC assuming VC=VM2.

$ASW_SEL$=0x01→$V2=GND1$ (first ground potential)

$ASW_SEL$=0x02→$V2=GND2$ (second ground potential)

$ASW_SEL$=0x04→$V2=VP1$ (first positive potential)

$ASW_SEL$=0x08→$V2=VP2$ (second positive potential)

$ASW_SEL$=0x10→$V2=VM1$ (first negative potential)

$ASW_SEL$=0x20→$V2=VM2(=VC)$ (second negative potential)

VSEL consists of one type of power supply potential values 2 which are selected by ASW_SEL, and which are arranged side by side along the time axis (see FIG. 5B).

LENGTH2 represents a period for each of the one type of power supply potential values V2 in VSEL, and is expressed by the number of internal clock pluses (2 digits of a hexadecimal value) used in the drive devices 41 similarly to the case of LENGTH1 described above in the example shown in FIG. 5B. It should be noted that in the example shown in FIGS. 5A and 5B, the values of LENGTH1 and LENGTH2 are the same as each other.

Here, it is arranged that the drive waveform in the drive signal Sd described above is set using VSEL and LENGTH2 described above included in the regular waveform configuration information Iw2. Further, in the waveform setting section 121 described above, a rule of converting VALUE in the simplified waveform configuration information Iw1 into ASW_SEL in the regular waveform configuration information Iw2 when generating the regular waveform configuration information Iw2 based on the simplified waveform configuration information Iw1 is, for example, as follows.

(a1) The configuration of the selection of ASW_SEL is replaced with a configuration of the selection of GND1/GND2 in the case of VALUE=GND, a configuration of the selection of VP1/VP2 in the case of VALUE=VP, and a configuration of the selection of VM1/VM2 in the case of VALUE=VM.

(b1) When the value of VALUE is set, in ASW_SEL, the value selected last time is not selected, but the other value is selected.

Here, in the detailed description of (hi) described above, in the example shown in FIGS. 5A and 5B, in the case of VALUE=0b00 (V1=GND), when ASW_SEL=0x01 (V2=GND1) was set last time, ASW_SEL=0x02 (V2=GND2) is selected this time. On this occasion, when ASW_SEL=0x02 (V2=GND2) was set last time, on the contrary, ASW_SEL=0x01 (V2=GND1) is selected this time.

Similarly, in the example shown in FIGS. 5A and 5B, in the case of VALUE=0b01 (V1=VP), when ASW_SEL=0x04 (V2=VP1) was set last time, ASW_SEL=0x08 (V2=VP2) is selected this time. On this occasion, when ASW_SEL=0x08 (V2=VP2) was set last time, on the contrary, ASW_SEL=0x04 (V2=VP1) is selected this time.

Similarly, in the example shown in FIGS. 5A and 5B, in the case of VALUE=0b10 (V1=VM), when ASW_SEL=0x10 (V2=VM1) was set last time, ASW_SEL=0x20 (V2=VM2) is selected this time. On this occasion, when ASW_SEL=0x20 (V2=VM2) was set last time, on the contrary, ASW_SEL=0x10 (V2=VM1) is selected this time.

In such a manner as described above, in the example shown in FIGS. 5A and 5B, the plurality of types (two types in this example) of power supply potential values V2 for each of the reference potential values V1 are set so as to take turns in a predetermined order (two types of power supply potential values V2 alternately take turns in this example) in a predetermined unit period ΔT. Although the details will be described later, the reason therefor is to apparently increase an allowable consumption current value per unit period ΔT in each of the power supply lines for each of the reference potentials (GND, VP, and VM in this example). Specifically, for example, when there are disposed two power supply lines the same in potential and each having the allowable consumption current value=300 [mA], the allowable consumption current value as a whole can be assumed as 600 [mA] when alternately selecting these two power supply lines to set the drive waveform. Further, besides the case of alternately selecting them in such a manner, it is possible to apparently increase the allowable consumption current in substantially the same manner when, for example, these two power supply lines are the same in use frequency (frequency of setting) in the unit period ΔT.

In other words, it can be said that it is desirable for the frequency of setting of each of the plurality of types of power supply potential values V2 for each of the reference potential values V1 in the unit period ΔT to be set in accordance with the ratio between the allowable consumption current values in the respective power supply lines corresponding to the respective power supply potential values V2 in such regular waveform configuration information Iw2. Specifically, for example, regarding V2=GND1/GND2 corresponding to V1=GND, when the ratio between the allowable consumption current values in each of the corresponding power supply lines is GND1:GND2=1:2, it is desirable for the ratio between the frequencies of setting of V2=GND/GND2 in the unit period ΔT to be GND1:GND2=1:2. Further, in the example described above, the frequencies of setting of the plurality of types of power supply potential values V2 for each of the reference potential values V1 in the unit period ΔT are made equivalent to each other (desirably the same, in other words, 1:1).

Here, the flexible boards 13*a* through 13*d* described above each correspond to a specific example of a "drive board" in the present disclosure. Further, the first control communication C1 corresponds to a specific example of "first control communication" in the present disclosure, the second control communication C2 corresponds to a specific example of "second control communication" in the present disclosure, and the third control communication C3*a* through C3*d* corresponds to a specific example of "third control communication" in the present disclosure. Further, VALUE described above corresponds to a specific example of "reference potential value information" in the present disclosure, and LENGTH1 described above corresponds to a specific example of "reference potential period information" in the present disclosure. Further, ASW_SEL described above corresponds to a specific example of "power supply selection information" in the present disclosure, VSEL described above corresponds to a specific example of "power supply potential value information" in the present disclosure, and LENGTH2 corresponds to a specific example of "power supply potential period information" in the present disclosure.

[Operations and Functions/Advantages]

(A. Basic Operation of Printer 5)

In the printer 5, a recording operation (a printing operation) of images, characters, and so on to the recording target medium (the recording paper P and so on) is performed using such a jet operation of the ink 9 by the inkjet head 1 as described below. Specifically, in the inkjet heads 1 according to the present embodiment, the jet operation of the ink 9 using a shear mode is performed in the following manner.

First, the drive devices 41 on each of the flexible boards 13*a*, 13*b*, 13*c*, and 13*d* each apply the drive voltage Vd (the drive signal Sd) to the drive electrodes (the common electrode and the active electrode) described above in the actuator plate 111 in the jet section 11. Specifically, each of the drive devices 41 applies the drive voltage Vd to the drive electrodes disposed on the pair of drive walls partitioning the ejection channel described above. Thus, the pair of drive walls each deform so as to protrude toward the dummy channel adjacent to the ejection channel.

On this occasion, it results in that the drive wall makes a flexion deformation to have a V shape centering on the intermediate position in the depth direction in the drive wall. Further, due to such a flexion deformation of the drive wall, the ejection channel deforms as if the ejection channel bulges. As described above, due to the flexion deformation caused by a piezoelectric thickness-shear effect in the pair of drive walls, the volume of the ejection channel increases. Further, by the volume of the ejection channel increasing, the ink 9 is induced into the ejection channel as a result.

Subsequently, the ink 9 having been induced into the ejection channel in such a manner turns to a pressure wave to propagate to the inside of the ejection channel. Then, the drive voltage Vd to be applied to the drive electrodes becomes 0 (zero) V at the timing at which the pressure wave has reached the nozzle hole Hn of the nozzle plate 112 (or timing in the vicinity of that timing). Thus, the drive walls are restored from the state of the flexion deformation described above, and as a result, the volume of the ejection channel having once increased is restored again.

In such a manner, the pressure in the ejection channel increases in the process that the volume of the ejection channel is restored, and thus, the ink 9 in the ejection channel is pressurized. As a result, the ink 9 having shaped like a droplet is ejected (see FIG. 1, FIG. 2, and FIG. 4) toward the outside (toward the recording paper P) through the nozzle hole Hn. The jet operation (the ejection operation) of the ink 9 in the inkjet head 1 is performed in such a manner, and as a result, the recording operation of images, characters, and so on to the recording paper P is performed.

(B. Detailed Operations and Functions/Advantages)

Then, the detailed operations, functions, and advantages in the inkjet head 1 according to the present embodiment will be described in comparison with a related-art method.

(B-1. Regarding Waveform Setting of Drive Signal in Related Art)

First, in recent years, complication of the drive waveform progresses in the drive signal for driving the jet section in the inkjet head. Such a complicated waveform is used aiming at a variety of effects such as a reduction in drive noise generated when performing ejection, a correction of a variation in ejection performance, or an improvement in print quality. Specifically, for example, in Document 1 described above, a correction in voltage is performed on a common drive waveform for driving the nozzles in order to suppress a variation in ejection volume of the nozzles.

However, such a method is effective for the drive of the inkjet head on the one hand, but the setting of the drive waveform itself becomes further complicated on the other hand. Further, such a complicated drive waveform is capable of exerting the on-target effect in the state in which the drive waveform is set correctly on the one hand, but assuming that the drive waveform is faultily set, there is a possibility that the on-target effect cannot be obtained, and moreover, a false operation, a malfunction, a breakage, and so on of the inkjet head are induced.

Further, for example, there can be cited a method in which it is arranged that a retrieving function of retrieving the drive waveform is provided in the inkjet head, and by comparing the drive waveform actually set to the inkjet head and the drive waveform which should originally be set to the inkjet head with each other, an error in the drive waveform setting is detected and then corrected. It should be noted that in this method, the comparison between the transmission data and the reception data related to the waveform setting is merely performed, and therefore, when the transmission data itself is wrong, no effect is obtained as a result. Further, when the transmission data corresponds to the complicated waveform setting, since it is necessary for the user to completely understand the complicated waveform setting, the burden on the user increases as a result.

In such a manner, it can be said that in the related-art method related to the waveform setting of the drive signal to be applied to the inkjet head, there is a possibility that the performance of the inkjet head deteriorates, or the convenience for the user decreases.

(B-2. Present Embodiment)

Therefore, in the inkjet head 1 according to the present embodiment, there is adopted the following configuration, and at the same time, it is arranged to perform the following operation. Thus, in the present embodiment, for example, such functions and advantages as described below can be obtained.

(Regarding Waveform Configuration Information)

First, in the present embodiment, the regular waveform configuration information Iw2 for setting the drive waveform of the drive signal Sd is generated in the waveform setting section 121 in the inkjet head 1 based on the simplified waveform configuration information Iw1 supplied from the outside (the print control section 2) of the inkjet head 1. Specifically, in the waveform setting section 121, the simplified waveform configuration information Iw1 including the reference potential values V1 described above is converted into the regular waveform configuration information Iw2 including the plurality of types of power supply potential values V2 set for each of the reference potential values V1.

Since the complicated waveform setting in the drive signal Sd is realized in the inkjet head 1 in such a manner, it becomes possible for the user of the inkjet head 1 to easily realize the such complicated waveform setting. In other words, it becomes unnecessary for the user of the inkjet head 1 to perform such complicated waveform setting by him- or herself before using the inkjet head 1. Therefore, in the present embodiment, it becomes possible to enhance the convenience while improving the performance of the inkjet head 1 (e.g., an improvement in image quality using an auxiliary pulse signal for reducing reverberation, reduction of consumption current, and realization of the print operation with high-frequency drive) using the drive signal Sd on which such complicated waveform setting has been performed.

Further, in the present embodiment, in the regular waveform configuration information Iw2, the frequency of setting of each of the plurality of types of power supply potential values V2 for each of the reference potential values V1 in the unit period ΔT described above is set in accordance with the ratio between the allowable consumption current values in the respective power supply lines corresponding to the respective power supply potential values V2 in such a manner as described above. Thus, it is possible to assume that the allowable consumption current value per unit period ΔT in each of the power supply lines for each of the reference potentials (e.g., GND, VP, and VM) has increased. Therefore, for example, even when performing the high-frequency drive in the inkjet head 1, it is possible to reduce the possibility of the breakage of the inkjet head 1. As a result, it becomes possible to further improve the performance of the inkjet head 1.

Further, in the present embodiment, since the frequencies of setting of the plurality of types of power supply potential values V2 for each of the reference potential values V1 in the unit period ΔT described above are made equivalent to each other in such a manner as described above, it results in the following. That is, it is possible to assume that the allowable consumption current value per unit period ΔT in each of the power supply lines for each of the reference potentials described above has further increased. Therefore, for example, even when performing the high-frequency drive in the inkjet head 1, it is possible to further reduce the possibility of the breakage of the inkjet head 1. As a result, it becomes possible to further improve the performance of the inkjet head 1.

In addition, in the present embodiment, since the plurality of types of power supply potential values V2 for each of the reference potential values V1 is set so as to take turns in the predetermined order in such a manner as described above in the unit period ΔT described above, it results in the following. That is, it becomes easy to make the frequencies of setting of the plurality of types of power supply potential values V2 for each of the reference potential values V1 equivalent to each other in the unit period ΔT as described above. As a result, it becomes possible to more easily improve the performance of the inkjet head 1.

Further, in the present embodiment, the simplified waveform configuration information Iw1 is configured by including the information (VALUE, LENGTH1) described above, and at the same time, the regular waveform configuration information Iw2 is configured by including the information (ASW_SEL, VSEL, and LENGTH2) described above. Thus, the drive waveform in the drive signal Sd is easily realized. In other words, such complicated waveform setting as described above in the drive signal Sd is more easily realized in the inkjet head 1. As a result, it becomes possible to further enhance the convenience.

Further, in the present embodiment, when it has been judged that the regular waveform configuration information Iw2 becomes inappropriate in content when the regular waveform configuration information Iw2 is generated based on the simplified waveform configuration information Iw1, the error notification (the notification of the first error information Ie1) is made to the outside (the print control section 2) of the inkjet head 1 from the waveform setting section 121, and therefore, it results in the following. That is, it is possible to avoid, for example, the possibility of the breakage of the inkjet head 1 and the possibility of the deterioration of the performance of the inkjet head 1 when setting the drive waveform of the drive signal Sd using the regular waveform configuration information Iw2 having such an inappropriate content. As a result, it becomes possible to improve the reliability of the inkjet head 1.

In addition, in the present embodiment, since the data amount Dw1 in the simplified waveform configuration information Iw1 is made smaller than the data amount Dw2 in the regular waveform configuration information Iw2 (Dw1<Dw2), it results in the following. In other words, it is possible to reduce the amount of data transmitted from the outside (e.g., an upstream circuit such as the print control section 2) of the inkjet head 1. Thus, it is possible to reduce the power consumption by the data transmission when performing such complicated waveform setting as described above in the drive signal Sd, and thus, it becomes possible to further improve the performance of the inkjet head 1. Further, since the transmission time of the data decreases, the time for setting from, for example, the upstream circuit described above to the inkjet head 1 also decreases. Thus, it is possible to perform other setting using the upstream circuit or software while the inkjet head 1 performs such complicated waveform setting as described above by itself, and therefore, it results in, for example, the reduction of the start-up time of the printer 5 as a whole. As a result, it becomes possible to further enhance the convenience. In addition, since the data amount Dw1 in the simplified waveform configuration information Iw1 is relatively small, it becomes possible to reduce the capacity of the memory and so on which becomes necessary in the inkjet head 1.

(Regarding Control Switch Action)

Further, in the present embodiment, the regular waveform configuration information Iw2 is generated in the waveform setting section 121 based on the simplified waveform configuration information Iw1 which is transferred from the outside (the print control section 2) of the inkjet head 1 to the waveform setting section 121 using the first control communication C1 on the external control line Lex described above. Then, when the regular waveform configuration information Iw2 which has been transmitted from the waveform setting section 121 to the control switch section 122 using the second control communication C2 on the internal control line Lin described above is transmitted from the control switch section 122 to the drive devices 41 using the third control communication C3*a* through C3*d* on the plurality of drive control lines Lda through Ldd, the control switch action between the transmission control action and the blocking control action described above is performed by the control switch section 122.

Figure 7:
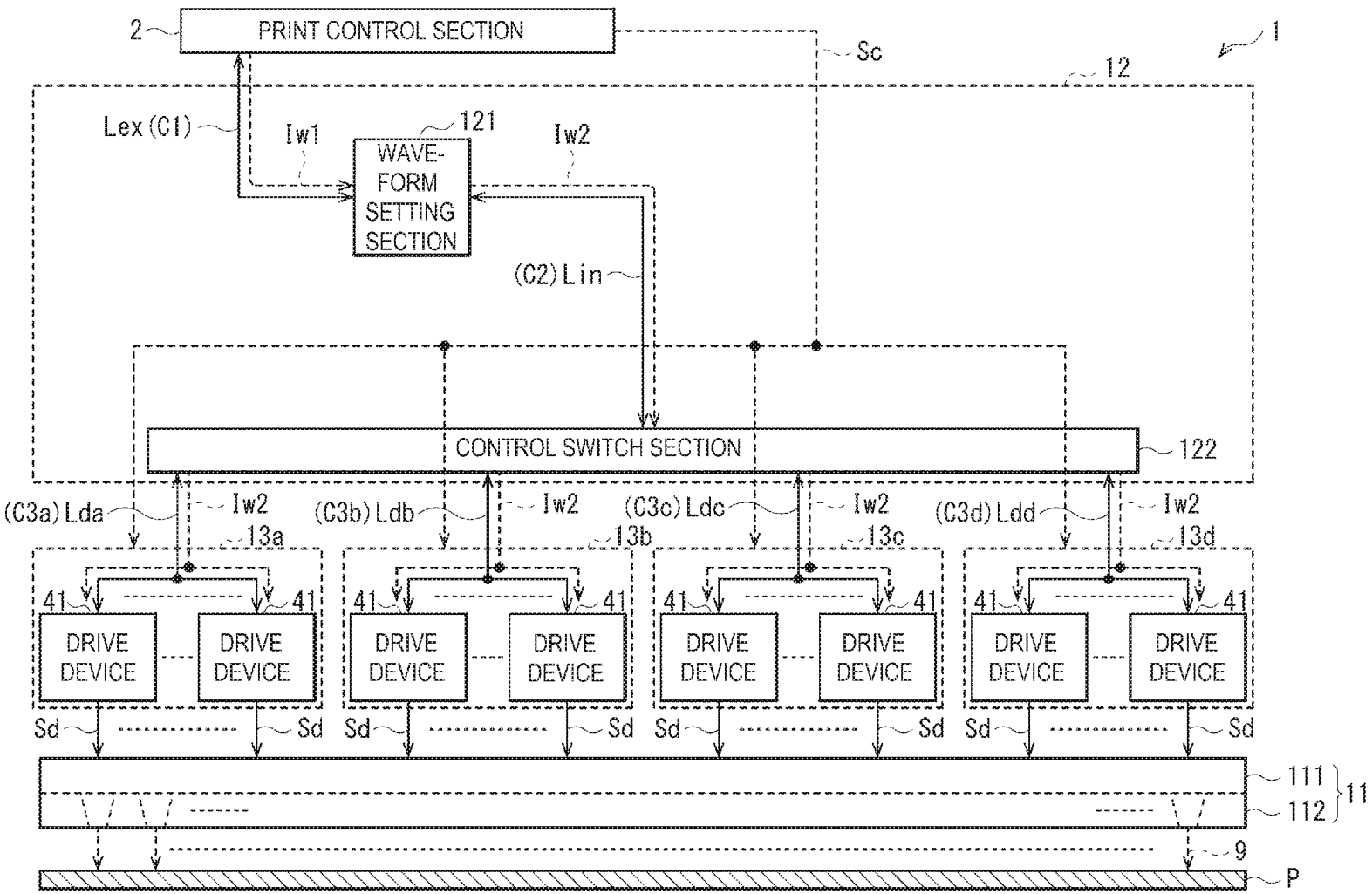
FIG. 7 is a block diagram showing an example of a transmission control action in the liquid jet head shown in FIG. 4.
Figure 8:
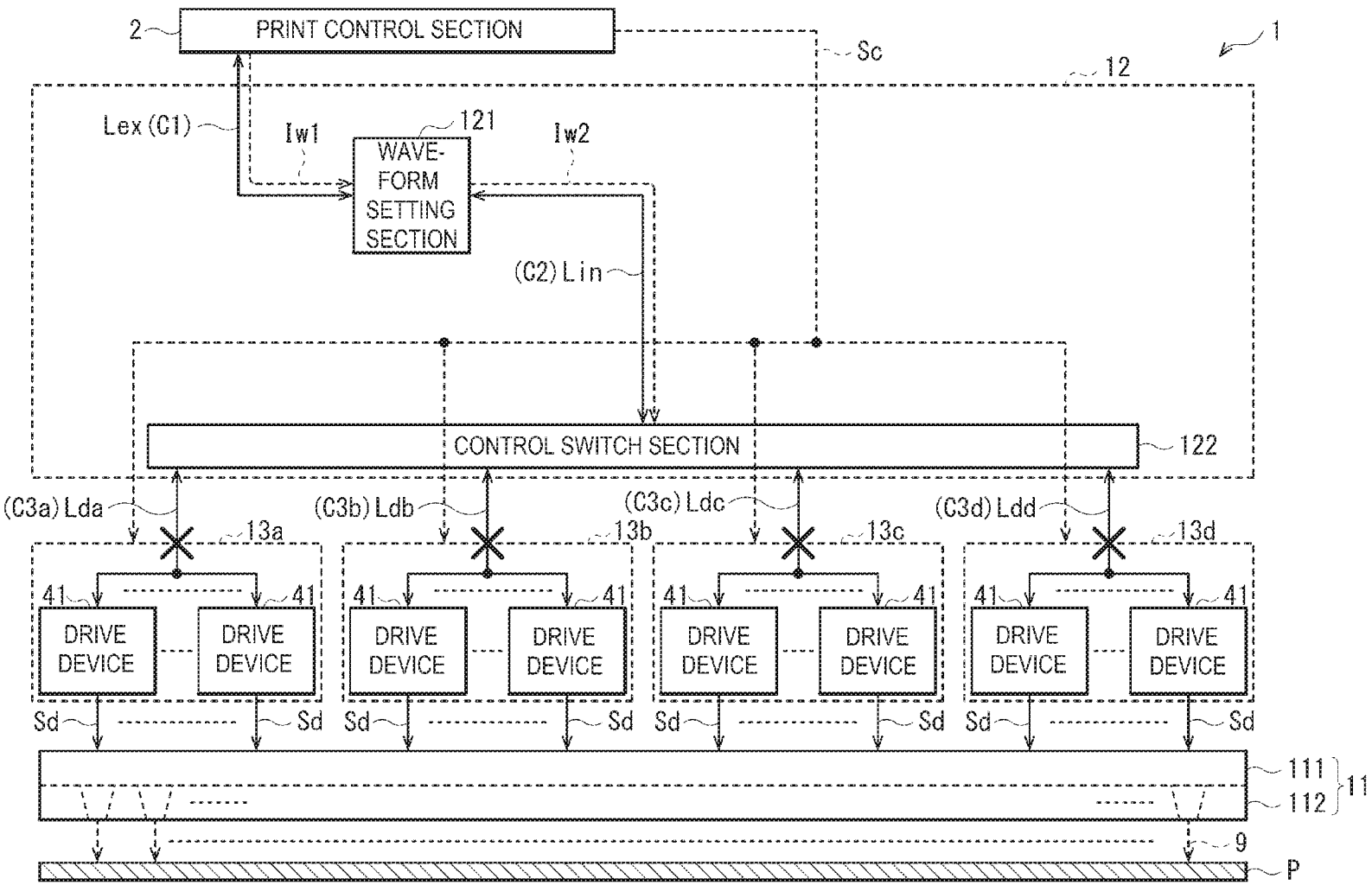
FIG. 8 is a block diagram showing an example of a blocking control action in the liquid jet head shown in FIG. 4.

Here, FIG. 7 and FIG. 8 are block diagrams respectively showing examples of such a transmission control action and such a blocking control action.

First, when performing the transmission control action shown in FIG. 7, the regular waveform configuration information Iw2 is transmitted using the third control communication (all of the third control communication C3*a* through C3*d* in this example) on at least one (all of the drive control lines Lda through Ldd in this example) of the plurality of drive control lines Lda through Ldd. Specifically, the regular waveform configuration information Iw2 is transmitted in parallel from the control switch section 122 to the drive devices 41 in at least one (all of the flexible boards 13*a* through 13*d* in this example) of the plurality of flexible boards 13*a* through 13*d* (see FIG. 7). Thus, it becomes possible to reduce the time (setting time) required for the setting of the drive waveform up to about ¼ compared to when, for example, the regular waveform configuration information Iw2 is sequentially transmitted to the drive devices 41 in each of the flexible boards 13*a* through 13*d*, as a result.

In contrast, when performing the blocking control action shown in FIG. 8, the transmission of the regular waveform configuration information Iw2 using the third control communication C3*a* through C3*d* is blocked by the control switch section 122 with respect to all of the plurality of drive control lines Lda through Ldd (see "X" marks in FIG. 8). That is, when performing the blocking control action, the regular waveform configuration information Iw2 having been transmitted from the waveform setting section 121 to the control switch section 122 is not transmitted to each of the drive devices 41 in all of the flexible boards 13*a* through 13*d* as a result.

In such a manner as described above, in the present embodiment, the regular waveform configuration information Iw2 is transmitted in parallel to the drive devices 41 in at least one of the plurality of flexible boards 13*a* through 13*d*, or the transmission of the regular waveform configuration information Iw2 using the third control communication C3*a* through C3*d* is blocked with respect to all of the plurality of drive control lines Lda through Ldd. Thus, there is easily realized a variety of types of waveform setting in the inkjet head 1 such as supplying the same regular waveform configuration information Iw2 in a lump in parallel to all of the drive devices 41 on the plurality of flexible boards 13*a* through 13*d* (collective waveform setting), or individually supplying the regular waveform configuration information Iw2 different from each other to the drive devices 41 on the plurality of flexible boards 13*a* through 13*d* (individual waveform setting). As a result, in the present embodiment, it becomes possible to further enhance the convenience in the inkjet head 1.

Further, in the present embodiment, the second error information Ie2 in at least one of the drive devices 41 is collected by the waveform setting section 121 and then stored using the third control communication C3*a* through C3*d* and the second control communication C2, and at the same time, such second error information Ie2 is output to the outside (the print control section 2) of the inkjet head 1 using the first control communication C1. Thus, since it is possible to save the trouble of individually collecting the second error information Ie2 with respect to all of the drive devices 41 in the inkjet head 1 by the user him- or herself of the inkjet head 1, it becomes possible to, for example, promptly deal with such an error. As a result, it becomes possible to further enhance the convenience in the inkjet head 1.

2. MODIFIED EXAMPLES

Then, some modified examples (Modified Example 1 through Modified Example 3) of the embodiment described above will be described. It should be noted that hereinafter, the same constituents as those in the embodiment are denoted by the same reference symbols, and the description thereof will arbitrarily be omitted.

Modified Example 1

(Configuration)

Figures 9A, 9B:
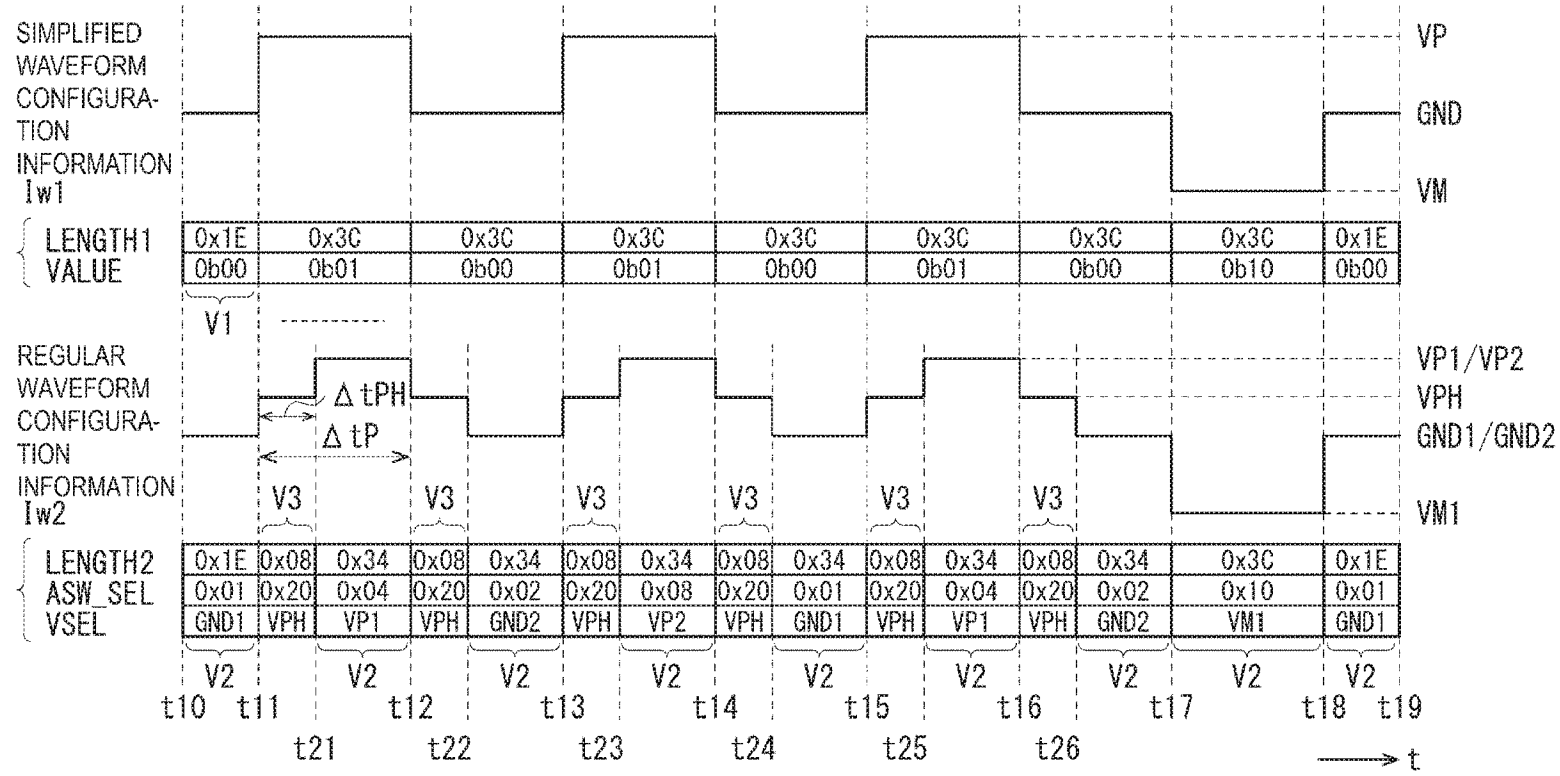
FIGS. 9A and 9B are timing charts showing a configuration example of simplified waveform configuration information and regular waveform configuration information related to Modified Example 1.

FIGS. 9A and 9B are timing charts showing a configuration example of the simplified waveform configuration information Iw1 (FIG. 9A) and a configuration example of the regular waveform configuration information Iw2 (FIG. 9B) applied in a liquid jet head according to Modified Example 1. It should be noted that the horizontal axis in FIGS. 9A and 9B represent time t. Further, FIG. 10A schematically shows a detailed configuration example of the reference potential value V1 shown in FIG. 9A, and FIG. 10B schematically shows a detailed configuration example of the power supply potential value V2 shown in FIG. 9B.

It should be noted that an inkjet head according to Modified Example 1 corresponds to a specific example of the "liquid jet head" in the present disclosure. Further, a printer equipped with the inkjet head according to Modified Example 1 corresponds to a specific example of the "liquid jet recording device" in the present disclosure.

In the waveform configuration information applied to Modified Example 1, the simplified waveform configuration information Iw1 shown in FIG. 9A is the same information as in the case of the embodiment shown in FIG. 5A on the one hand, but the regular waveform configuration information Iw2 shown in FIG. 9B is different from the case of the embodiment shown in FIG. 5B on the other hand.

Specifically, the regular waveform configuration information Iw2 in Modified Example 1 is obtained by additionally setting information (intermediate potential value information V3) representing VPH as an intermediate potential value described hereinafter in the regular waveform configuration information Iw2 in the embodiment (see FIG. 9B). In particular, in the example shown in FIG. 9B, such intermediate potential value information V3 is additionally set between the power supply potential values V2 along the time axis in each of a period between the timings t11 and t12 (the timing t11 and timing t21), a period between the timings t12 and t13 (the timing t12 and timing t22), a period between the timings t13 and t14 (the timing t13 and timing t23), a period between the timings t14 and t15 (the timing t14 and timing t24), a period between the timings t15 and t16 (the timing t15 and timing t25), and a period between the timings t16 and t17 (the timing t16 and timing t26).

In contrast, it is arranged that such intermediate potential value information V3 is not included in the simplified waveform configuration information Iw1 in Modified Example 1 (see FIG. 9A) similarly to the simplified waveform configuration information Iw1 in the embodiment.

Here, a correspondence relationship example between VALUE and the reference potential value V1 in the simplified waveform configuration information Iw1 is made substantially the same as in the case of the embodiment shown in FIG. 6A. In contrast, a correspondence relationship example between ASW_SEL and the power supply potential value V2 in the regular waveform configuration information Iw2 shown in FIG. 10B is also substantially the same as in the embodiment shown in FIG. 6B in the elementary sense, but in the example shown in FIG. 10B, it is arranged that VC=VPH is set in the case of ASW_SEL=0x20.

VPH (VSEL=VPH) as the intermediate potential value described above is a potential value located between a minimum value (GND1/GND2) and a maximum value (VP1/VP2) out of the power supply potential values V2 to be set in the drive waveform of the drive signal Sd. Further, in the example shown in FIG. 9B, such VPH is set to VPH=(the maximum value (VP1/VP2))×0.5. It should be noted that the value of VPH is not limited to this example ((the maximum value)×0.5), and it is sufficient for the value of VPH to be a potential value located between the minimum value and the maximum value.

Further, such VPH is arranged to be set only for a short period of time in a rising stage or a falling stage when setting the stepwise drive waveform (a rising edge and a falling edge of the waveform) as shown in FIG. 9B. Specifically, the waveform is set so that VPH inevitably intervenes in such a rising stage and such a falling stage. Thus, it becomes possible to reduce the power consumption (the drive current to the jet section 11 as a load capacity) when setting such a stepwise drive waveform although the details will be described later.

Here, in the waveform setting section 121 in Modified Example 1, the rule of converting VALUE in the simplified waveform configuration information Iw1 into ASW_SEL in the regular waveform configuration information Iw2 is, for example, as follows similarly to the case of the embodiment described above in the elementary sense.

(a2) The configuration of the selection of ASW_SEL is replaced with a configuration of the selection of GND1/GND2 in the case of VALUE=GND, a configuration of the selection of VP1/VP2 in the case of VALUE=VP, and a configuration of the selection of VM1 in the case of VALUE=VM.

(b2) When the value of VALUE is set, in ASW_SEL, the value selected last time is not selected, but the other value is selected (substantially the same as in (b1) described above).

(c2) When rising from (GND1/GND2) to (VP1/VP2), the value of LENGTH2 defining the period of (VP1/VP2) is decreased (e.g., decreased by about 0x08 corresponding to 0.4 [μs]), and at the same time, the value of LENGTH2 defining the period of VPH is set to the decrement (see FIG. 9B).

(d2) When falling from (VP1/VP2) to (GND1/GND2), the value of LENGTH2 defining the period of (GND1/GND2) is decreased (e.g., decreased by about 0x08 corresponding to 0.4 [μs]), and at the same time, the value of LENGTH2 defining the period of VPH is set to the decrement (see FIG. 9B).

Further, also in Modified Example 1, similarly to the embodiment, when it has been judged that the regular waveform configuration information Iw2 becomes inappropriate in content when the regular waveform configuration information Iw2 is generated based on the simplified waveform configuration information Iw1, the notification of the first error information Ie1 is made to the print control section 2 from the waveform setting section 121. Specifically, in particular in Modified Example 1, when, for example, the regular waveform configuration information Iw2 has the content (ΔtPH≥ΔtP) representing the fact that the length of the setting period (see a period ΔtPH shown in FIG. 9B) of VPH described above becomes longer than the length of the setting period (see a period ΔtP shown in FIG. 9B) of original (VP1/VP2) or original (GND1/GND2), it is judged that the regular waveform configuration information Iw2 becomes inappropriate in content. This is because when (ΔtPH≥ΔtP) is realized, the period of (VP1/VP2) or (GND1/GND2) disappears when adding the setting period of VPH, and it results in an inappropriate drive waveform. It should be noted that the information representing the length of such a setting period of VPH is arranged to be stored in, for example, the waveform setting section 121 or a waveform storage section 123.

(Functions/Advantages)

In such a manner, in Modified Example 1, since it is arranged that the intermediate potential value information V3 described above is additionally set in the regular waveform configuration information Iw2, and at the same time, the intermediate potential value information V3 is not included in the simplified waveform configuration information Iw1, it results in the following. That is, by setting the drive waveform of the drive signal Sd using such intermediate potential value information V3 while suppressing the data amount Dw1 in the simplified waveform configuration information Iw1, it is possible to reduce the power consumption when setting the stepwise drive waveform (e.g., the rising edge and the falling edge of the waveform) as shown in, for example, FIG. 9B. As a result, it becomes possible to easily realize the reduction in power consumption in the whole of the inkjet head according to Modified Example 1 in the inkjet head.

Modified Example 2

(Configuration)

Figure 11:
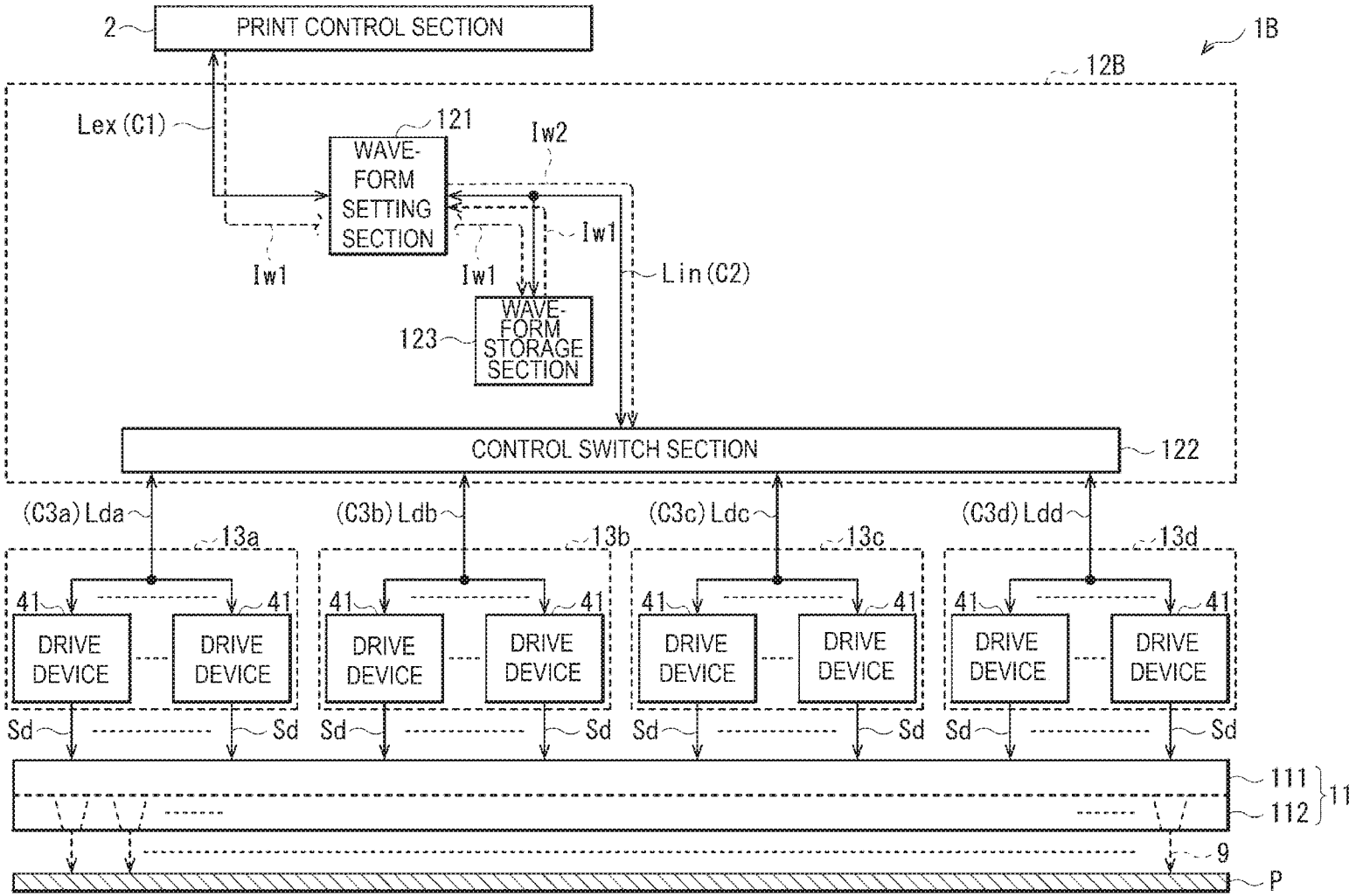
FIG. 11 is a block diagram showing a configuration example of a liquid jet head related to Modified Example 2.

FIG. 11 is a block diagram showing a configuration example of a liquid jet head (an inkjet head 1B) according to Modified Example 2. The inkjet head 1B according to Modified Example 2 corresponds to what is obtained by disposing an I/F board 12B instead of the I/F board 12 in the inkjet head 1 according to the embodiment shown in FIG. 4, and the rest of the configuration is made substantially the same.

It should be noted that the inkjet head 1B corresponds to a specific example of the "liquid jet head" in the present disclosure. Further, a printer equipped with the inkjet head 1B corresponds to a specific example of the "liquid jet recording device" in the present disclosure.

The I/F board 12B corresponds what is obtained by further dispose the waveform storage section 123 in the I/F board 12, and the rest of the configuration is made substantially the same.

As shown in FIG. 11, the waveform storage section 123 is for storing the simplified waveform configuration information Iw1 which has been transmitted from the outside (the print control section 2) of the inkjet head 1B using the first control communication C1. Further, it is arranged that the waveform setting section 121 generates the regular waveform configuration information Iw2 based on the simplified waveform configuration information Iw1 stored in the waveform storage section 123 in such a manner (see FIG. 11). Then, when performing the transmission control action described above by the control switch section 122, the regular waveform configuration information Iw2 generated by the waveform setting section 121 in such a manner is transmitted from the waveform setting section 121 to each of the drive devices 41 via the control switch section 122 using the third control communication C3*a* through C3*d* as a result.

(Functions/Advantages)

In such a manner, in Modified Example 2, the simplified waveform configuration information Iw1 which has been transmitted from the outside (the print control section 2) of the inkjet head 1B using the first control communication 1C is stored in the waveform storage section 123, and at the same time, the regular waveform configuration information Iw2 is generated in the waveform setting section 121 based on the simplified waveform configuration information Iw1 thus stored. Then, when performing the transmission control action by the control switch section 122, the regular waveform configuration information Iw2 is transmitted to the drive devices 41 using the third control communication C3*a* through C3*d*.

Thus, for the user of the inkjet head 1B, only by storing the simplified waveform configuration information Iw1 in the waveform storage section 123, the regular waveform configuration information Iw2 is generated in the inkjet head 1B, and is then supplied to the drive devices 41 as a result. Further, due to such a configuration, it becomes possible to, for example, generate the regular waveform configuration information Iw2 after correcting the false waveform setting included in the simplified waveform configuration information Iw1. Therefore, as a result the waveform setting in the inkjet head 1B is more easily realized, and at the same time, the correctness in waveform setting is also improved, it becomes possible to improve the performance of the inkjet head 1B while further increasing the convenience in the inkjet head 1B.

Modified Example 3

(Configuration)

Figure 12:
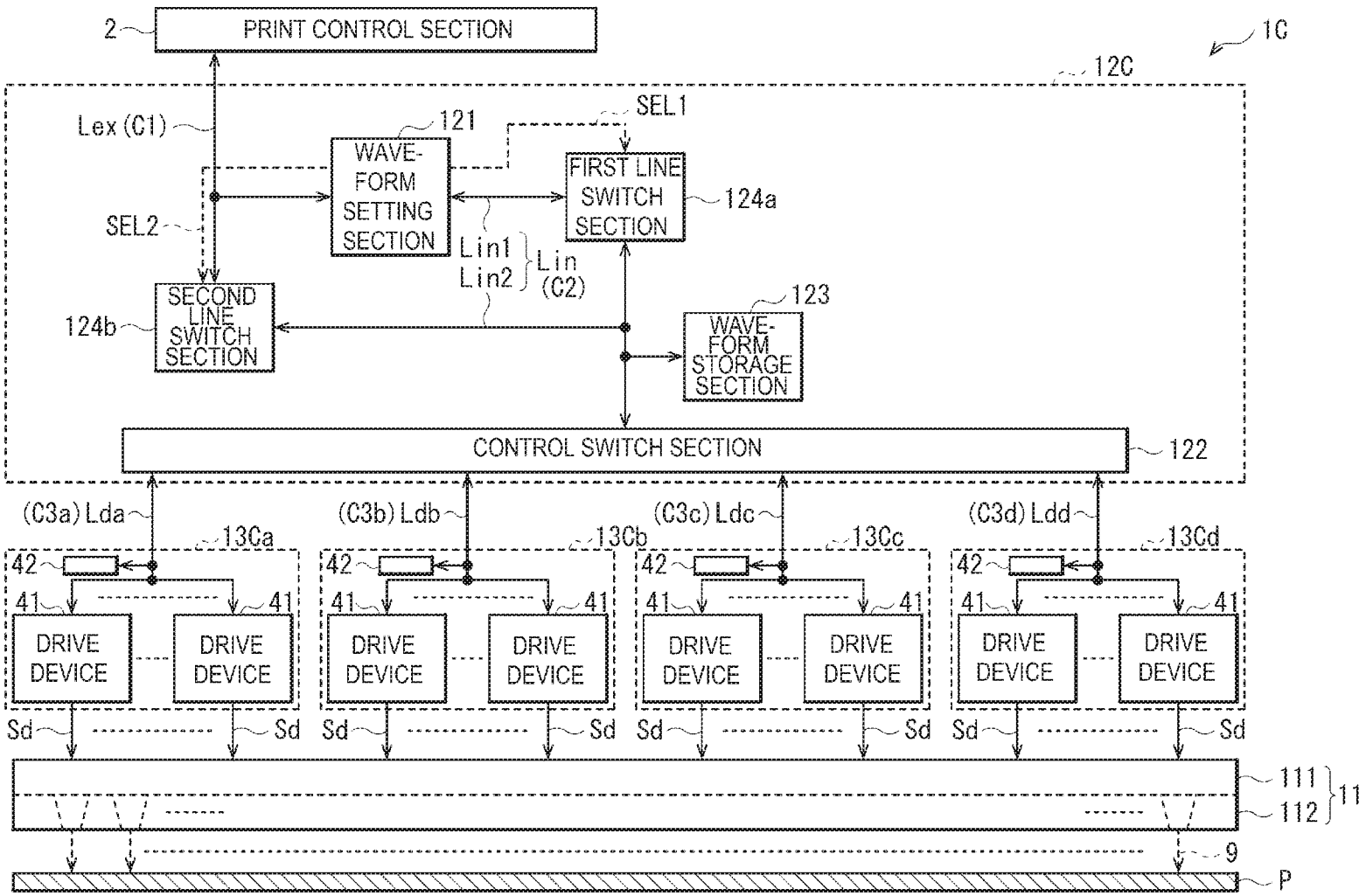
FIG. 12 is a block diagram showing a configuration example of a liquid jet head related to Modified Example 3.
Figure 13:
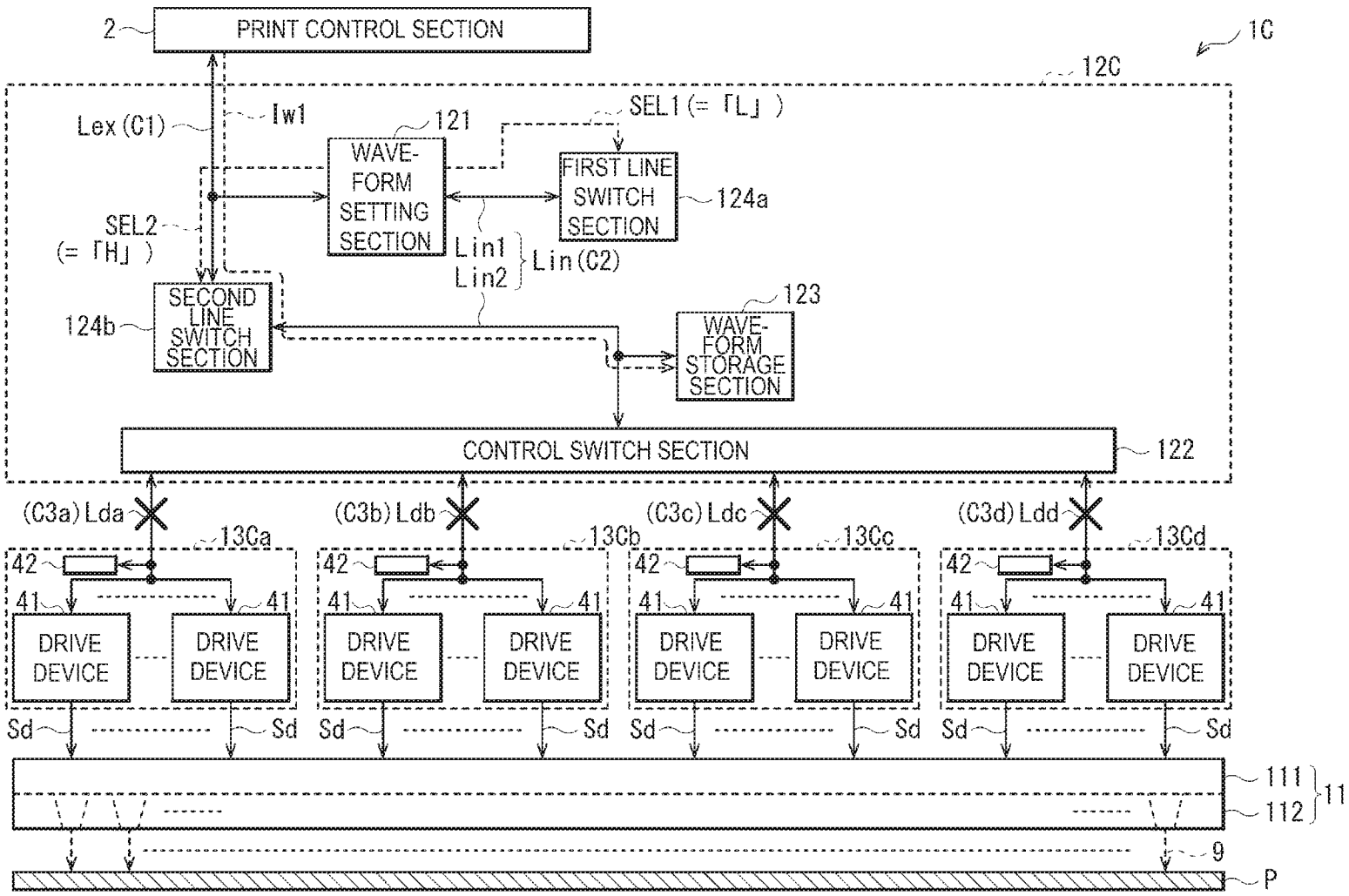
FIG. 13 is a block diagram showing an action example when performing direct control communication in the liquid jet head shown in FIG. 12.
Figure 14:
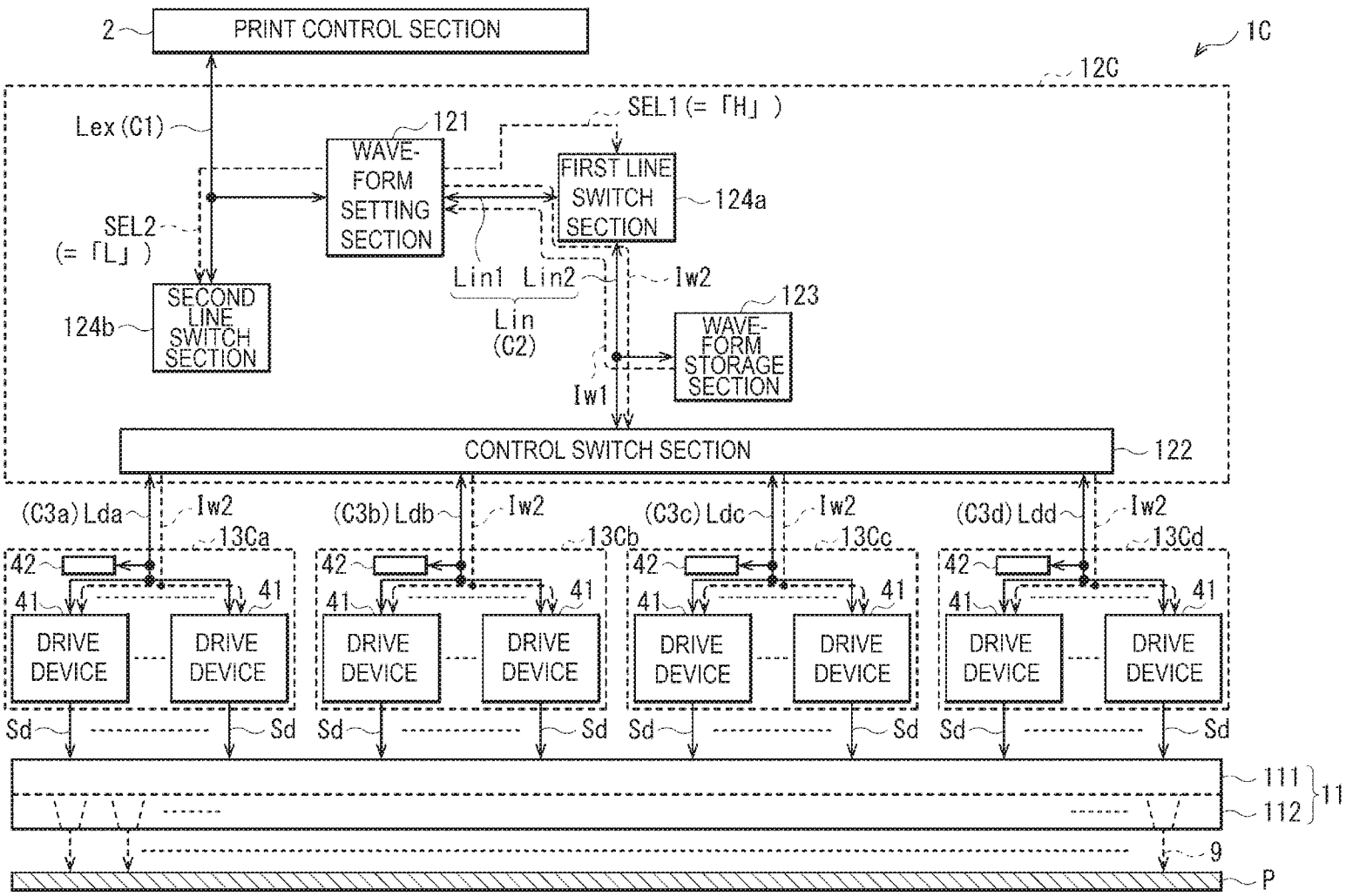
FIG. 14 is a block diagram showing an action example when performing indirect control communication in the liquid jet head shown in FIG. 12.
Figure 15:
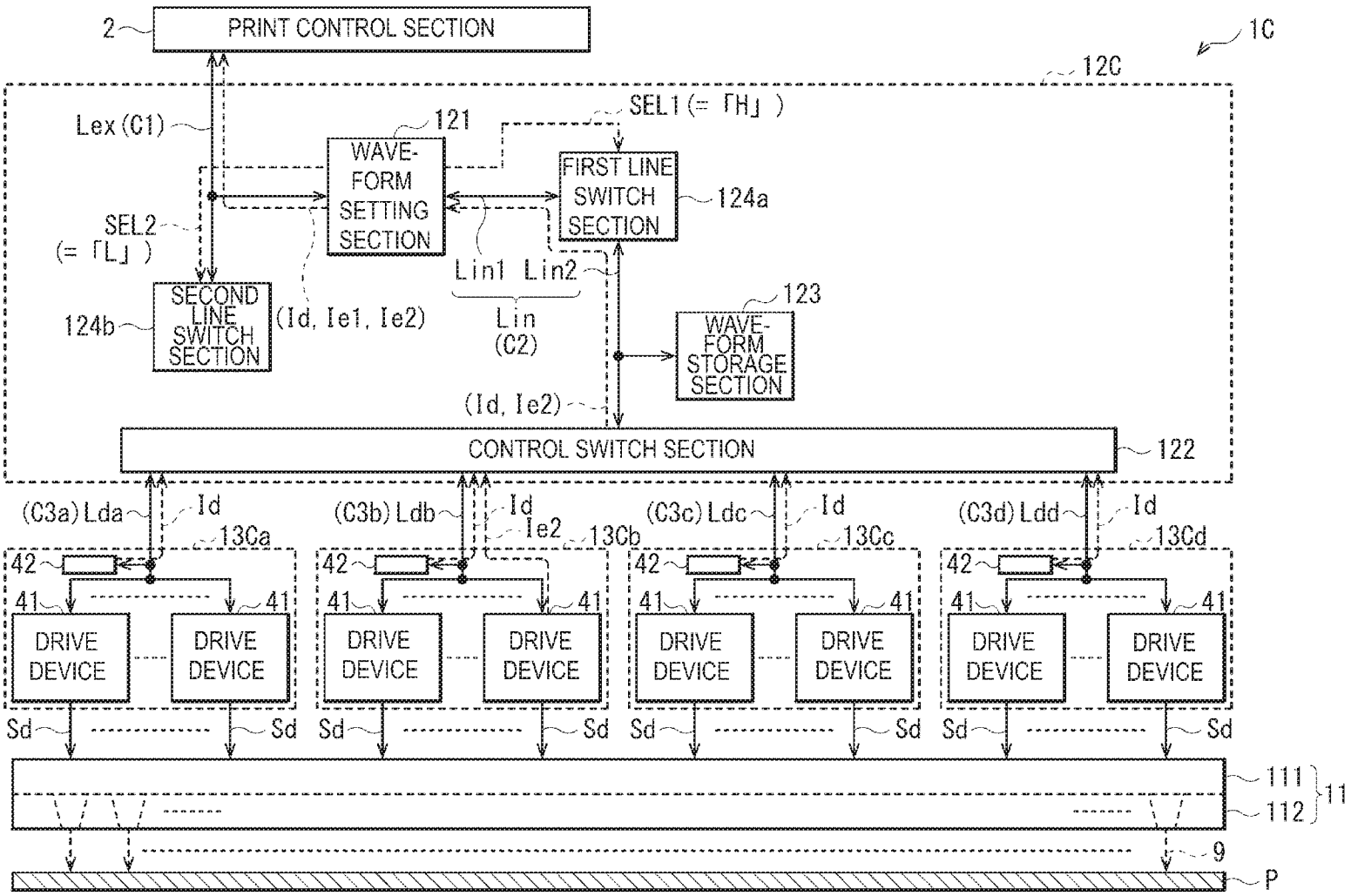
FIG. 15 is a block diagram showing another action example when performing the indirect control communication in the liquid jet head shown in FIG. 12.

FIG. 12 is a block diagram showing a configuration example of a liquid jet head (an inkjet head 1C) according to Modified Example 3. Further, FIG. 13 is a block diagram showing an operation example when performing direct control communication described later in the inkjet head 1C. In contrast, FIG. 14 and FIG. 15 are each a block diagram showing an operation example when performing indirect control communication described later in the inkjet head 1C.

The inkjet head 1C according to Modified Example 3 corresponds to what is obtained by disposing an I/F board 12C and flexible boards 13Ca through 13Cd instead of the I/F board 12B and the flexible boards 13*a* through 13*d* in the inkjet head 1B according to Modified Example 2 shown in FIG. 11, and the rest of the configuration is made substantially the same.

The I/F board 12C corresponds to what is obtained by further disposing a first line switch section 124*a* and a second line switch section 124*b* in the I/F board 12B, and at the same time, making the internal control line Lin be constituted by a first internal control line Lin1 and a second internal control line Lin2, and the rest of the configuration is made substantially the same.

Here, the inkjet head 1C corresponds to a specific example of the "liquid jet head" in the present disclosure. Further, a printer equipped with the inkjet head 1C corresponds to a specific example of the "liquid jet recording device" in the present disclosure.

Further, the flexible boards 13Ca through 13Cd respectively correspond to what are further provided with the drive information storage sections 42 in the flexible boards 13*a* through 13*d* described hereinabove, and the rest of the configuration is made substantially the same (see FIG. 12 through FIG. 15).

The drive information storage sections 42 are respectively disposed on the drive control lines Lda through Ldd, and are for storing drive information Id including the drive conditions (e.g., a variety of drive conditions appropriate for improving the ejection performance) in the corresponding flexible boards 13Ca through 13Cd, respectively. As such drive information Id, there are included, for example, information related to drive of the nozzle arrays in the jet sections 11 respectively coupled to the flexible boards 13Ca through 13Cd, and voltage information (rank voltages) to be used for suppressing a variation in ejection performance between such nozzle arrays. Further, it is possible to arrange that individual identification information of the nozzle array itself, information of performance data at the time of shipment from factory of the inkjet head 1C, information of accumulated operation time of the inkjet head 1C, and so on are included in the drive information Id. When adopting the configuration in which the drive information Id includes such information, even when the I/F board 12C is supposedly replaced, it becomes possible to succeed such information related to the jet section 11 without modification.

As shown in FIG. 12, the first internal control line Lin1 described above is disposed between the waveform setting section 121 and the first line switch section 124*a*. Further, as shown in FIG. 12, the second internal control line Lin2 is disposed between the first line switch section 124*a* and the second line switch section 124*b*, and the control switch section 122 and the waveform storage section 123.

The first line switch section 124*a* and the second line switch section 124*b* are for performing connection switch of the control line (a line switch section) so that one of the indirect control communication (see FIG. 14 and FIG. 15) and the direct control communication (see FIG. 13) is selectively performed. Specifically, the first line switch section 124*a* is arranged to selectively be set to a connected state when performing the indirect control communication (see FIG. 14 and FIG. 15), and the second line switch section 124*b* is arranged to selectively be set to the connected state when performing the direct control communication (see FIG. 13).

Further, such selective connection control is performed using selection signals SEL1, SEL2 respectively output to the first line switch section 124*a* and the second line switch section 124*b* from the waveform setting section 121 (see FIG. 12 through FIG. 15). Specifically, when performing the indirect control communication, by the waveform setting section 121 setting the selection signals to SEL1="H (high)" state and SEL2="L (low)" state, the first line switch section 124*a* is set to the connected state (a valid state), and the second line switch section 124*b* is set to an unconnected state (an invalid state) (see FIG. 14 and FIG. 15). In contrast, when performing the direct control communication, by the waveform setting section 121 setting the selection signals to SEL1="L" state and SEL2="H" state, the first line switch section 124*a* is set to the unconnected state (the invalid state), and the second line switch section 124*b* is set to the connected state (the valid state) (see FIG. 13).

Here, as shown in, for example, FIG. 13, the direct control communication means the control communication between the outside (the print control section 2) of the inkjet head 1C and the control switch section 122 without the waveform setting section 121 intervening therebetween. It is arranged that when performing the direct control communication, as described above, by the second line switch section 124*b* being selectively set to the connected state, the print control section 2, and the control switch section 122 and the waveform storage section 123 are directly (without the waveform setting section 121 intervening therebetween) coupled to each other via the external control line Lex, the second line switch section 124*b*, and the second internal control line Lin2 (see FIG. 13). Therefore, it is arranged that as shown in, for example, FIG. 13, the simplified waveform configuration information Iw1 can directly (without the waveform setting section 121 intervening therebetween) be supplied to the waveform storage section 123 from the print control section 2 when performing the waveform setting in the inkjet head 1C. Further, it is arranged that when performing such direct control communication, the control switch section 122 performs the blocking control action described above to thereby block the connection between the external control line Lex and each of the drive control lines Lda through Ldd (see the "X" marks shown in FIG. 13).

In contrast, as shown in, for example, FIG. 14 and FIG. 15, the indirect control communication means the control communication between the outside (the print control section 2) of the inkjet head 1C and the control switch section 122 via the waveform setting section 121. It is arranged that when performing the indirect control communication, as described above, by the first line switch section 124*a* being selectively set to the connected state, the print control section 2, and the control switch section 122 and the waveform storage section 123 are indirectly (via the waveform setting section 121) coupled to each other via the external control line Lex, the waveform setting section 121, the first internal control line Lin1, the first line switch section 124*a*, and the second internal control line Lin2 (see FIG. 14 and FIG. 15). Therefore, as shown in, for example, FIG. 14, it is arranged that when performing the waveform setting in the inkjet head 1C, the simplified waveform configuration information Iw1 stored in the waveform storage section 123 is supplied to the waveform setting section 121 via the second internal control line Lin2, the first line switch section 124*a*, and the first internal control line Lint. Further, it is arranged that the regular waveform configuration information Iw2 generated by the waveform setting section 121 is supplied to the control switch section 122 via the first internal control line Lin1, the first line switch section 124*a*, and the second internal control line Lin2 (see FIG. 14). Further, it is arranged that the control switch section 122 performs the transmission control action described above to thereby transmit the regular waveform configuration information Iw2 thus received to the drive devices 41 in each of the flexible boards 13Ca through 13Cd using the third control communication C3*a* through C3*d* (see FIG. 14).

Further, as shown in, for example, FIG. 15, it is arranged that the waveform setting section 121 outputs the drive information Id to the outside (the print control section 2) of the inkjet head 1C in addition to the variety of types of error information (the first error information Ie1 and the second error information Ie2) when performing the indirect control communication. Specifically, the waveform setting section 121 first collects and stores the drive information Id from the drive information storage sections 42 described above on the respective drive control lines Lda through Ldd using the third control communication C3*a* through C3*d* and the second control communication C2 (see FIG. 15). Then, the waveform setting section 121 is arranged to output the drive information Id stored in such a manner to the print control section 2 using the first control communication C1 (see FIG. 15).

(Functions/Advantages)

In such a manner, in the inkjet head 1C according to Modified Example 3, the connection switch by the line switch section (the first line switch section 124*a* and the second line switch section 124*b*) is performed so that one of the indirect control communication and the direct control communication described above is performed, and therefore, it results in the following. That is, since it becomes possible to perform the direct control communication without the intervention of the waveform setting section 121 as needed, it becomes possible to directly supply the simplified waveform configuration information Iw1 from the outside (the print control section 2) of the inkjet head 1C to the waveform storage section 123 when, for example, performing the waveform setting in the inkjet head 1C. Thus, since it is possible to avoid a delay and so on of the processing in the waveform setting section 121 unlike the case of using the indirect control communication via the waveform setting section 121, it is possible to promptly perform the waveform setting in the inkjet head 1C. As a result, it becomes possible to further enhance the convenience in the inkjet head 1C.

Here, the delay and so on of the processing in the waveform setting section 121 will be described in detail as follows. That is, first, when retrieving and writing the simplified waveform configuration information Iw1 from and into the waveform storage section 123, it is necessary for the waveform setting section 121 to judge, for example, whether or not the communication is the control communication to the waveform storage section 123, and then, perform the control communication to the waveform storage section 123 using the internal control line Lin only when such communication is the control communication. When arranging that such a sorting process of the control communication is performed in the waveform setting section 121, the sorting process and the control communication to the waveform storage section 123 occur after the control communication from the print control section 2 to the waveform setting section 121. Further, during that period, it becomes unachievable for the print control section 2 to perform subsequent control communication, which incurs generation of wait time. As a result, since such wait time frequently occurs when performing the drive waveform setting which is performed using a large amount of control communication, the time for performing the drive waveform setting significantly increases.

Further, in Modified Example 3, the line switch section described above is configured by including the first line switch section 124*a* and the second line switch section 124*b*, and the internal control line Lin is configured by including the first internal control line Lin1 and the second internal control line Lin2, and therefore, it results in the following. That is, when performing the indirect control communication and the direct control communication described above, one of the first line switch section 124*a* and the second line switch section 124*b* alone is selectively set to the connected state. Therefore, it is possible to make it impossible to concurrently perform the control (the control using the direct control communication) from the outside (the print control section 2) of the inkjet head 1C and the control (the control using the indirect control communication) from the waveform setting section 121 on the waveform storage section 123 and the control switch section 122. Thus, such prompt waveform setting in the inkjet head 1C as described above is easily realized, and as a result, it becomes possible to achieve a further enhancement of the convenience in the inkjet head 1C.

Further, in Modified Example 3, when performing the direct control communication, the connection between the external control line Lex and the plurality of drive control lines Lda through Ldd is blocked by the control switch section 122 performing the blocking control action, and therefore, it results in the following. That is, since there is established the state in which the waveform setting section 121 and the waveform storage section 123 can only be recognized with respect to the inside of the inkjet head IC from the outside (e.g., the upstream circuit such as the print control section 2) of the inkjet head 1C, it is possible to, for example, prevent the wrong waveform setting from being performed on the drive devices 41 from the outside of the inkjet head 1C. Thus, it becomes possible to further enhance the convenience in the inkjet head 1C, and at the same time, it becomes possible to prevent the deterioration of the performance of the inkjet head 1C due to such wrong waveform setting as described above.

In addition, in Modified Example 3, the drive information Id stored in the drive information storage section 42 is collected and stored by the waveform setting section 121 using the third control communication C3*a* through C3*d* and the second control communication C2, and at the same time, such drive information Id is output to the outside (the print control section 2) of the inkjet head 1C using the first control communication C1. Thus, it is possible to save the trouble of individually collecting the drive information Id including the drive condition described above in each of the flexible boards 13*a* through 13*d* by the user him- or herself of the inkjet head 1C, and thus, it is possible to easily obtain the drive information Id. As a result, it becomes possible to further enhance the convenience in the inkjet head 1C.

3. OTHER MODIFIED EXAMPLES

The present disclosure is described hereinabove citing the embodiment and some modified examples, but the present disclosure is not limited to the embodiment and so on, and a variety of modifications can be adopted.

For example, in the embodiment and so on described above, the description is presented specifically citing the configuration examples (the shapes, the arrangements, the number and so on) of each of the members in the printer and the inkjet head, but those described in the above embodiment and so on are not limitations, and it is possible to adopt other shapes, arrangements, numbers and so on.

Specifically, for example, in the embodiment and so on described above, the description is presented specifically citing the configuration examples of the I/F board, the flexible board (the drive board), the drive device, the variety of control lines, the line switch section, and so on, but these configuration examples are not limited to those described in the above embodiment and so on. For example, in the embodiment and so on described above, the description is presented citing when the "drive board" in the present disclosure is the flexible board as an example, but the "drive board" in the present disclosure can also be, for example, a nonflexible board. Further, in the above embodiment and so on, there is described when the "line switch section" is constituted by the two line switch sections (the first line switch section 124*a* and the second line switch section 124*b*) as an example of the "line switch section" in the present disclosure, but the "line switch section" in the present disclosure can be realized using other configurations.

Further, the numerical examples of the variety of parameters described in the above embodiment and so on are not limited to the numerical examples described in the embodiment and so on, and can also be other numerical values. Further, the data configuration example of the waveform configuration information (the simplified waveform configuration information Iw1 and the regular waveform configuration information Iw2) described in the above embodiment and so on is not limited to the example described in the above embodiment and so on, and can also be other data configurations.

In addition, the control switch actions (the transmission control action and the blocking control action), the actions of the indirect control communication and the direct control communication, the generation action of the waveform configuration information (the regular waveform configuration information Iw2), the notification action of the variety of types of error information, and so on are not limited to the action examples described in the above embodiment and so on, and other action examples can also be adopted.

Further, as the structure of the inkjet head, it is possible to apply those of a variety of types. Specifically, for example, it is possible to adopt a so-called side-shoot type inkjet head which emits the ink 9 from a central portion in the extending direction of each of the ejection channels in the actuator plate 111. Alternatively, it is possible to adopt, for example, a so-called edge-shoot type inkjet head for ejecting the ink 9 along the extending direction of each of the ejection channels. Further, the type of the printer is not limited to the type described in the embodiment and so on described above, and it is possible to apply a variety of types such as an MEMS (Micro Electro-Mechanical Systems) type.

Further, for example, it is possible to apply the present disclosure to either of an inkjet head of a circulation type which uses the ink 9 while circulating the ink 9 between the ink tank and the inkjet head, and an inkjet head of a non-circulation type which uses the ink 9 without circulating the ink 9.

Further, the series of processes described in the above embodiment and so on can be arranged to be performed by hardware (a circuit), or can also be arranged to be performed by software (a program). When arranging that the series of processes is performed by the software, the software is constituted by a program group for making the computer perform the functions. The programs can be incorporated in advance in the computer described above and are then used, or can also be installed in the computer described above from a network or a recording medium and are then used.

Further, in the above embodiment and so on, the description is presented citing the printer (the inkjet printer) as a specific example of the "liquid jet recording device" in the present disclosure, but this example is not a limitation, and it is also possible to apply the present disclosure to other devices than the inkjet printer. In other words, it is also possible to arrange that the "liquid jet head" (the inkjet head) of the present disclosure is applied to other devices than the inkjet printer. Specifically, it is also possible to arrange that the "liquid jet head" of the present disclosure is applied to a device such as a facsimile or an on-demand printer.

In addition, it is also possible to apply the variety of examples described hereinabove in arbitrary combination.

It should be noted that the advantages described in the specification are illustrative only and are not a limitation, and other advantages can also be provided.

Further, the present disclosure can also take the following configurations.

<1> A liquid jet head configured to jet liquid comprising: a jet section configured to jet the liquid; at least one drive device which applies a drive signal having a predetermined drive waveform to the jet section to thereby cause the jet section to jet the liquid; and a waveform setting section configured to generate regular waveform configuration information for setting the drive waveform based on simplified waveform configuration information supplied from an outside of the liquid jet head, wherein the waveform setting section converts the simplified waveform configuration information including at least one type of reference potential value set along a time axis into the regular waveform configuration information including a plurality of types of power supply potential values set for each of the reference potential values to thereby generate the regular waveform configuration information based on the simplified waveform configuration information.

<2> The liquid jet head according to <1>, wherein in the regular waveform configuration information, a setting frequencies of the plurality of types of power supply potential values for each of the reference potential values in a unit period are set in accordance with a ratio of allowable consumption current values in respective power supply lines corresponding to the respective power supply potential values.

<3> The liquid jet head according to <2>, wherein the setting frequencies of the plurality of types of power supply potential values for each of the reference potential values in the unit period are made equivalent to each other.

<4> The liquid jet head according to <3>, wherein in the unit period, the plurality of types of power supply potential values for each of the reference potential values are set so as to take turns in a predetermined order.

<5> The liquid jet head according to any one of <1> to <4>, wherein the simplified waveform configuration information includes reference potential value information in which arbitrary reference potential values selected and set from the at least one type of reference potential value are arranged side by side along the time axis, and reference potential period information representing periods for each of the arbitrary reference potential values in the reference potential value information, the regular waveform configuration information includes power supply selection information which is set for each of the arbitrary reference potential values, and is configured to select one type of power supply potential value in the plurality of types of power supply potential values, power supply potential value information in which the one type of power supply potential value selected by the power supply selection information is arranged side by side along the time axis, and power supply potential period information representing a period for each of the one type of power supply potential value in the power supply potential value information, and the drive waveform in the drive signal is set using the power supply potential value information and the power supply potential period information.

<6> The liquid jet head according to any one of <1> to <5>, wherein information representing an intermediate potential value between a minimum value and a maximum value of the power supply potential values set in the drive waveform is additionally set in the regular waveform configuration information, and the information representing the intermediate potential value is arranged not to be included in the simplified waveform configuration information.

<7> The liquid jet head according to any one of <1> to <6>, wherein the waveform setting section performs an error notification to the outside of the liquid jet head in case that the waveform setting section judges that the regular waveform configuration information becomes inappropriate when generating the regular waveform configuration information based on the simplified waveform configuration information.

<8> The liquid jet head according to any one of <1> to <7>, wherein an amount of data in the simplified waveform configuration information is made smaller than an amount of data in the regular waveform configuration information.

<9> The liquid jet head according to any one of <1> to <8>, further comprising: a plurality of drive boards each having the at least one drive device; a control switch section disposed between the waveform setting section and the plurality of drive boards; an external control line in which first control communication between the outside of the liquid jet head and the waveform setting section is performed; an internal control line in which second control communication between the waveform setting section and the control switch section is performed; and a plurality of drive control lines in which third control communication is individually performed between the control switch section and the drive device in each of the plurality of drive boards, wherein the waveform setting section generates the regular waveform configuration information based on the simplified waveform configuration information transmitted from the outside of the liquid jet head using the first control communication, and the control switch section performs control switch between a transmission control action and a blocking control action when transmitting the regular waveform configuration information, which is transmitted from the waveform setting section using the second control communication, to the drive devices using the third control communication, wherein in the transmission control action, the regular waveform configuration information is transmitted in parallel to the drive devices in at least one drive board in the plurality of drive boards using the third control communication on at least one drive control line in the plurality of drive control lines, and in the blocking control action, the transmission of the regular waveform configuration information using the third control communication is blocked with respect to all of the plurality of drive control lines.

<10> A liquid jet recording device comprising the liquid jet head according to any one of <1> to <9>.

What is claimed is:

1. A liquid jet head configured to jet liquid comprising:

a jet section configured to jet the liquid;

at least one drive device which applies a drive signal having a predetermined drive waveform to the jet section to thereby cause the jet section to jet the liquid; and a waveform setting section configured to generate regular waveform configuration information for setting the drive waveform based on simplified waveform configuration information supplied from an outside of the liquid jet head, wherein the waveform setting section converts the simplified waveform configuration information including at least one type of reference potential value set along a time axis into the regular waveform configuration information including a plurality of types of power supply potential values set for each of the reference potential values to thereby generate the regular waveform configuration information based on the simplified waveform configuration information.

2. The liquid jet head according to claim 1, wherein in the regular waveform configuration information, a setting frequencies of the plurality of types of power supply potential values for each of the reference potential values in a unit period are set in accordance with a ratio of allowable consumption current values in respective power supply lines corresponding to the respective power supply potential values.

3. The liquid jet head according to claim 2, wherein the setting frequencies of the plurality of types of power supply potential values for each of the reference potential values in the unit period are made equivalent to each other.

4. The liquid jet head according to claim 3, wherein in the unit period, the plurality of types of power supply potential values for each of the reference potential values are set so as to take turns in a predetermined order.

5. The liquid jet head according to claim 1, wherein the simplified waveform configuration information includes:

reference potential value information in which arbitrary reference potential values selected and set from the at least one type of reference potential value are arranged side by side along the time axis, and reference potential period information representing periods for each of the arbitrary reference potential values in the reference potential value information, the regular waveform configuration information includes:

power supply selection information which is set for each of the arbitrary reference potential values, and is configured to select one type of power supply potential value in the plurality of types of power supply potential values, power supply potential value information in which the one type of power supply potential value selected by the power supply selection information is arranged side by side along the time axis, and power supply potential period information representing a period for each of the one type of power supply potential value in the power supply potential value information, and the drive waveform in the drive signal is set using the power supply potential value information and the power supply potential period information.

6. The liquid jet head according to claim 1, wherein information representing an intermediate potential value between a minimum value and a maximum value of the power supply potential values set in the drive waveform is additionally set in the regular waveform configuration information, and the information representing the intermediate potential value is arranged not to be included in the simplified waveform configuration information.

7. The liquid jet head according to claim 1, wherein the waveform setting section performs an error notification to the outside of the liquid jet head in case that the waveform setting section judges that the regular waveform configuration information becomes inappropriate when generating the regular waveform configuration information based on the simplified waveform configuration information.

8. The liquid jet head according to claim 1, wherein an amount of data in the simplified waveform configuration information is made smaller than an amount of data in the regular waveform configuration information.

9. The liquid jet head according to claim 1, further comprising:

a plurality of drive boards each having the at least one drive device;

a control switch section disposed between the waveform setting section and the plurality of drive boards;

an external control line in which first control communication between the outside of the liquid jet head and the waveform setting section is performed;

an internal control line in which second control communication between the waveform setting section and the control switch section is performed; and a plurality of drive control lines in which third control communication is individually performed between the control switch section and the drive device in each of the plurality of drive boards, wherein the waveform setting section generates the regular waveform configuration information based on the simplified waveform configuration information transmitted from the outside of the liquid jet head using the first control communication, and the control switch section performs control switch between a transmission control action and a blocking control action when transmitting the regular waveform configuration information, which is transmitted from the waveform setting section using the second control communication, to the drive devices using the third control communication, wherein in the transmission control action, the regular waveform configuration information is transmitted in parallel to the drive devices in at least one drive board in the plurality of drive boards using the third control communication on at least one drive control line in the plurality of drive control lines, and in the blocking control action, the transmission of the regular waveform configuration information using the third control communication is blocked with respect to all of the plurality of drive control lines.

10. A liquid jet recording device comprising the liquid jet head according to claim 1.

* * * * *